United States Patent [19]

Williams et al.

[11] Patent Number: 4,838,052

[45] Date of Patent: Jun. 13, 1989

[54] LOCK SYSTEM

[75] Inventors: John P. Williams, Barrington, Ill.; Chin-Jung Huang; Wen-Chyi Shyu, both of Shien, Taiwan

[73] Assignee: Segwill Corp., Barrington, Ill.

[21] Appl. No.: 76,610

[22] Filed: Jul. 23, 1987

[51] Int. Cl.[4] ..... E05B 65/52

[52] U.S. Cl. ..... 70/63; 70/277; 70/278; 109/52

[58] Field of Search ..... 70/52, 54, 55, 57, 58, 70/63, 271, 275-278, DIG. 59; 109/52

[56] References Cited

U.S. PATENT DOCUMENTS

| | | | |
|---|---|---|---|
| 1,955,809 | 4/1934 | Hobbs | 70/63 X |
| 1,983,716 | 12/1934 | Vidal | 70/63 X |
| 2,706,393 | 4/1955 | Jamieson et al. | 70/63 X |
| 3,236,075 | 2/1966 | Williams | 70/63 |
| 3,436,937 | 4/1969 | Barrett | 70/63 |
| 3,529,454 | 9/1970 | Fish | 70/278 |
| 3,878,511 | 4/1975 | Wagner . | |
| 3,889,078 | 6/1975 | Wessman | 70/271 X |
| 3,979,932 | 9/1976 | Piche | 70/63 |
| 4,079,605 | 3/1978 | Bartels | 70/277 |
| 4,092,524 | 5/1978 | Moreno . | |
| 4,148,092 | 4/1979 | Martin | 70/283 X |
| 4,211,443 | 7/1980 | Butts et al. | 70/277 X |
| 4,426,862 | 1/1984 | Yamada et al. | 70/278 X |
| 4,509,093 | 4/1985 | Stellberger . | |
| 4,522,047 | 6/1985 | Johl | 70/278 X |
| 4,532,783 | 8/1985 | Maurice | 70/63 |
| 4,609,780 | 9/1986 | Clark . | |
| 4,649,723 | 3/1987 | Appelbaum | 70/63 |
| 4,665,397 | 5/1987 | Pinnow . | |
| 4,671,084 | 6/1987 | Yung S. Lin . | |
| 4,718,259 | 1/1988 | Appelbaum | 109/52 X |
| 4,727,368 | 2/1988 | Larson et al. | 70/63 X |
| 4,766,746 | 8/1988 | Henderson et al. . | |

FOREIGN PATENT DOCUMENTS

| | | | |
|---|---|---|---|
| 05069 | 8/1987 | World Int. Prop. O. | 70/278 |

OTHER PUBLICATIONS

Brochure entitled "Agent Key for the EAC-1000 Key Safe System", copyright date of 1982.

Brochure entitled SUPRAGRAM, subtitle "The Supra EAC 1000: Alive and Well and Working Great!", with a date of summer 1987.

*Primary Examiner*—Robert L. Wolfe

*Assistant Examiner*—Suzanne L. Dino

*Attorney, Agent, or Firm*—Dressler, Goldsmith Shore, Sutker & Milnamow, Ltd.

[57] ABSTRACT

An electromechanical key safe includes a housing with a region defined therein. The region can be closed by means of a pivoted door attached to the housing. The door carries an electronic control system as well as a manually operable keypad. In response to entry of a sequence of characters through the keypad, the control system compares the entered sequence to a predetermined sequence of valid combinations. If a match is detected, the matched combination is checked to determine whether or not it is enabled. In the event that a matched combination is enabled, the lock system can be unlocked or actuated. In the event that a predetermined and matched combination is not enabled, the lock system cannot be unlocked.

30 Claims, 8 Drawing Sheets

FIG. 4
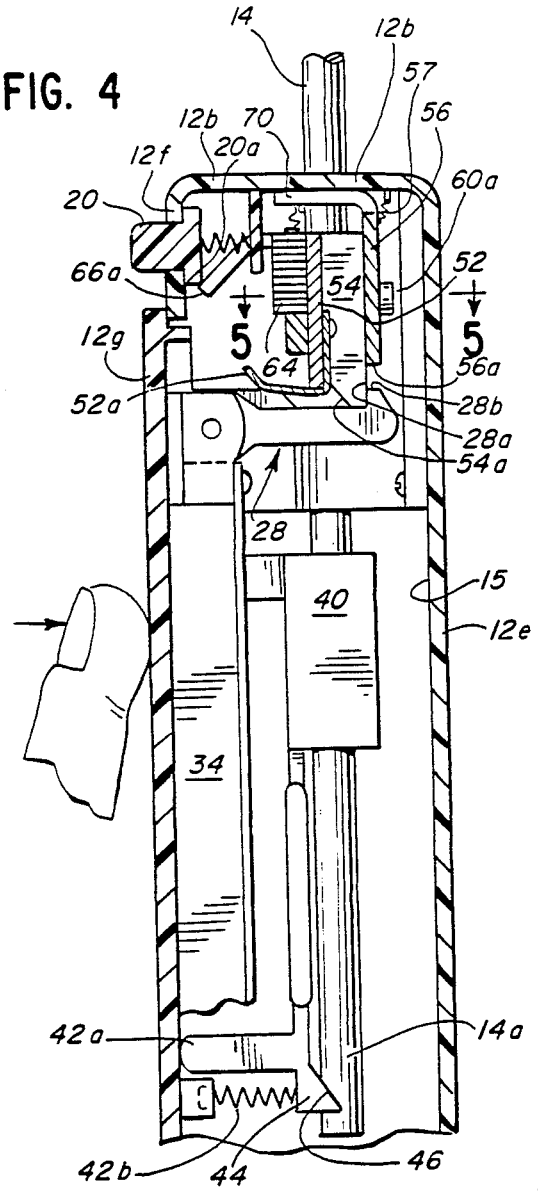
FIG. 6
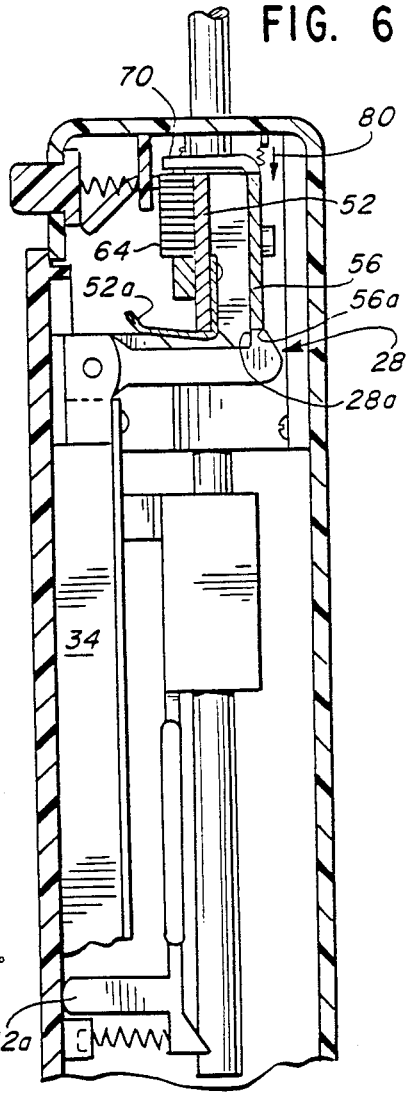
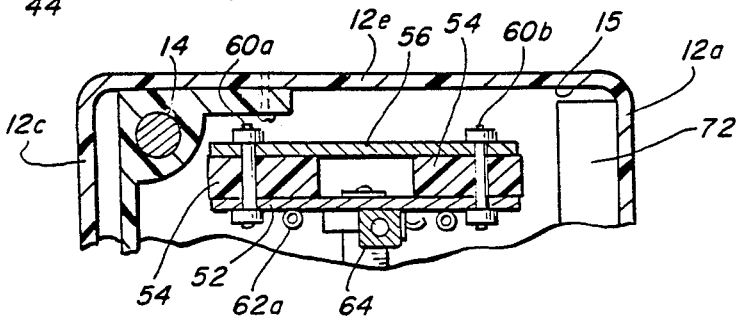
FIG. 5

FIG. 14
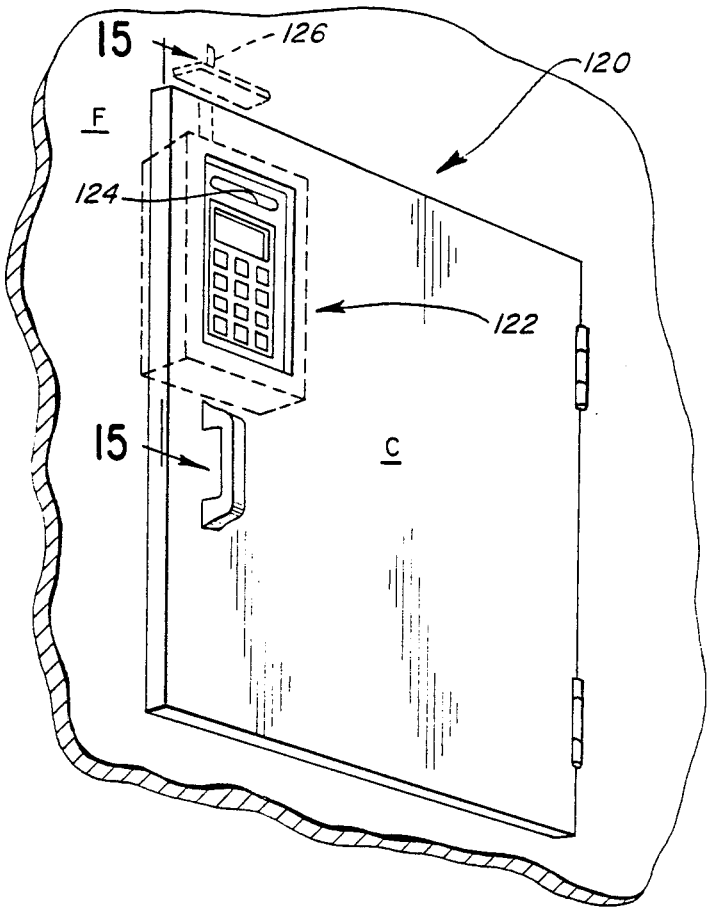
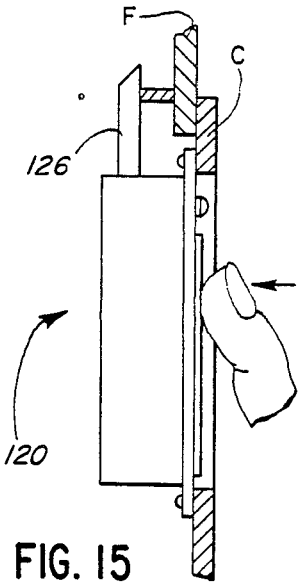
FIG. 15
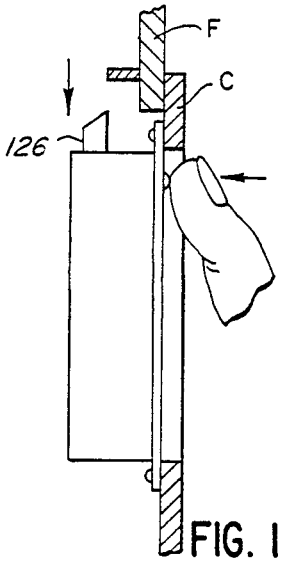
FIG. 16
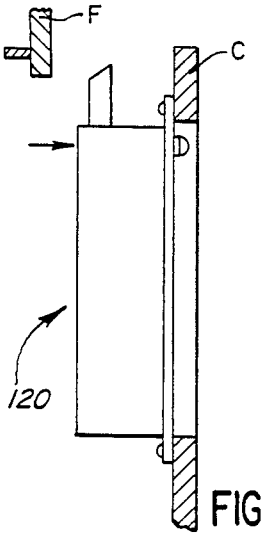
FIG. 17

LOCK SYSTEM

FIELD OF THE INVENTION

The invention pertains to the field of electronic combination lock systems. More particularly, the invention pertains to lock systems and related methods for providing controlled access to an area by means of limited use unlocking sequences.

BACKGROUND OF THE INVENTION

In the residential real estate industry, an obvious and major part of marketing a home for sale is the physical showing of property to a potential buyer by a sales broker or agent. If the owner is at home, entry can be readily achieved without the broker or agent needing a key.

In the vast majority of showings, the owner is not at home. The real estate agent has to somehow obtain a key. A key can be obtained from the listing broker to show the house. The key then has to be returned. This takes time and a great amount of effort. It presents a substantial logistics problem, time wise, to real estate brokers. It is this effort, known as "key chasing," which needs to be eliminated, or measurably reduced.

Lock boxes or key safes now exist which house keys to a particular home offered for sale. The lock box is attached to the residence to allow a real estate agent to take a customer directly to the property. The lock box is unlocked with a special key issued to the agent. The house key can then be removed from the lock box and used to gain access to the property. A known type of lock box is illustrated, in U.S. Pat. No. 3,436,937 issued to Barrett.

With regard to known, key operated lock boxes, it is necessary for the key to be widely distributed. Typically, all of the agents in a given Real Estate Board would have a master key that unlocks all of the boxes used within the area of that Board. The number of keys in circulation might range from 20 to 400. As a result, the listing agent has little knowledge or control over whether the property is entered, when it is entered or by whom.

The broker is unable to report to the client as to the extent of interest in the property that he has been able to generate. Further, the large number of keys in circulation causes both the listing broker and the client to have concern for the security of the property.

Combination lock key boxes partially eliminate these problems if the internal combination is set to a new value each time the lock is installed at a different property. In this case, an agent wishing to enter a given property must communicate with the listing broker to determine the combination in use at a given property.

However, for subsequent entries to the same property, the agent already knows the combination and need not check with the listing broker to reenter. In addition, the combination for a given property is readily passed to other persons. Of course, these problems could be circumvented if the listing broker changed the combination after each time that the property was entered. This is an impractical solution however. This solution would entail as much work as the key "chasing."

While the use of lock boxes is convenient and does eliminate "key chasing," it does not afford the owner or his agent desirable control and information. If the residence was shown in the owner's absence, it may not be possible to determine who showed the property and when. Because known lock boxes fail to provide this information, and additionally raises security questions in owner's minds, many real estate offices prefer not to use the lock box as it now exists. This, creates, by necessity, the logistical problem of "key chasing."

There thus continues to be a need for lock boxes or key safes which provide ready access to the stored key but which control initial access as well as repeated access by one or more parties to the stored key. Further, there continues to be a need for a key safe which can be opened without the need of a special key but still has the aforementioned access control capabilities.

SUMMARY OF THE INVENTION

In accordance with the invention an apparatus and a method are provided for permitting controlled access to a region. The apparatus, a lock system, includes a multiple sided, generally rectangular shaped, housing. The housing defines an interior region therein. The interior region of the housing can be closed by a pivotably attached front panel.

A lock, affixed to the housing within the interior region, will lock the front panel to the housing until a valid input sequence has been entered. Input sequences can be entered into the lock system by means of a manually operable keypad affixed to the front panel.

The keypad includes 12 buttons. Ten of the buttons are numerically coded. Two of the buttons, the "*" and the "#" can be used for definition of selected special functions.

Affixed to an interior surface of the front panel is an electronic control system which can receive the input sequence from the keypad. The electronic control system is electrically coupled to a solenoid. The solenoid is an integral part of the lock mechanism.

The electronic control system can include a programmable processor as well as read only memory and random access memory. The processor can sense when an input sequence has been entered through the keypad. The entered input sequence is compared to a plurality of predetermined valid combinations.

If a match is detected between the input sequence and one member of the plurality of predetermined valid combinations, the processor can check to determine whether or not the matched combination has been enabled. If so, the processor energizes the solenoid.

The energized solenoid mechanically couples a locking plate member to a camming plate member within the lock mechanism. Once the two members are mechanically coupled together, the operator wishing to open the lock system can depress an unlocking bar which is carried by the housing. Depressing the unlocking bar deflects the coupled together camming member and locking member. This coupled together and deflected combination trips the lock mechanism. The front panel is forced open, away from its locked position, to an intermediate position by an internal biasing spring. The front panel can then be moved from its intermediate position to its fully opened position to provide access to the region within the housing.

In one embodiment of the present invention an object such as a key for a lock can be stored in the region within the housing. Once the lock system has been opened, the stored key can then be retrieved and used to unlock the related door lock. In another embodiment of the present invention, instead of opening the front panel on the housing, movement of the coupled together cam plate and locking plate can cause movement of a dead bolt. The dead bolt can be moved from a locked position to an unlocked position. In the unlocked position, a cabinet or door, previously locked closed, can then be opened to provide access to a region on the other side of the door.

Further in accordance with the invention, the programmable processor can automatically test each matched valid combination to determine whether or not that combination should be switched from an activated to a deactivated state. A prestored valid combination which has been set to a deactivated state will no longer actuate the solenoid.

Further, in accordance with the invention, a method of providing controlled access to a closed region is provided. The method includes a step of entering an input sequence. The entered input sequence is compared to the members of a plurality of predetermined valid unlocking sequences. If the entered input sequence matches one of the members of the predetermined plurality, the matched member of the plurality is tested to determine whether or not that sequence, though valid, has been enabled.

In the event that the matched sequence has been enabled an unlocking mechanism is actuated providing access to the selected region. In the event that the matched sequence has been deactivated the unlocking mechanism is not actuated.

Further, in accordance with the invention a method is provided for accessing rooms such as hotel rooms. The method includes providing a first enabling sequence which will enable a lock system for the room. A second sequence is then entered into the lock by the guest. The second sequence can be used to unlock the room as many times as desired during that period of time in which the lock system has been enabled. After a predetermined period of time, the lock system can be disabled and the unlocking sequence no longer functions to provide access to the room.

In an alternate to this method, the enabling sequence can be provided by hotel or motel management. The guest can then enter an arbitrary multicharacter sequence into the lock to be used to activate the lock during the stay. In this embodiment none but the entering guest would know what the multidigit operating sequence for the lock is during this stay. At the end of the stay the lock can be disabled. Subsequently a new multicharacter enabling sequence can be provided to the next guest assigned to that particular room. That subsequent guest could then enter another arbitrary multicharacter operating sequence.

Numerous other advantages and features of the present invention will become readily apparent from the following detailed description of the invention and the embodiments thereof, from the claims and from the accompanying drawings in which the details of the invention are fully and completely disclosed as a part of this specification.

BRIEF DESCRIPTION OF THE DRAWINGS

FIG. 4 is an enlarged fragmentary side sectional view of the lock system of FIG. 1, taken along plane 4—4 of FIG. 3, illustrating the interrelationship of the components of the lock mechanism when the front panel is locked closed;

FIG. 5 is a sectional view taken along plane 5—5 of FIG. 4;

FIG. 6 is an enlarged fragmentary side sectional view of the lock system of FIG. 1 taken along plane 4—4 of FIG. 3 illustrating an initial coupling together of portions of the lock mechanism prior to unlocking the lock system;

FIG. 14 is an enlarged, fragmentary perspective view of an alternate embodiment of a lock system in accordance with the present invention; and FIGS. 15–17 taken together illustrate in a side sectional view taken along plane 15—15 of FIG. 14, an operational sequence for unlocking the lock system of FIG. 14.

DETAILED DESCRIPTION OF THE PREFERRED EMBODIMENT

Figure 1:
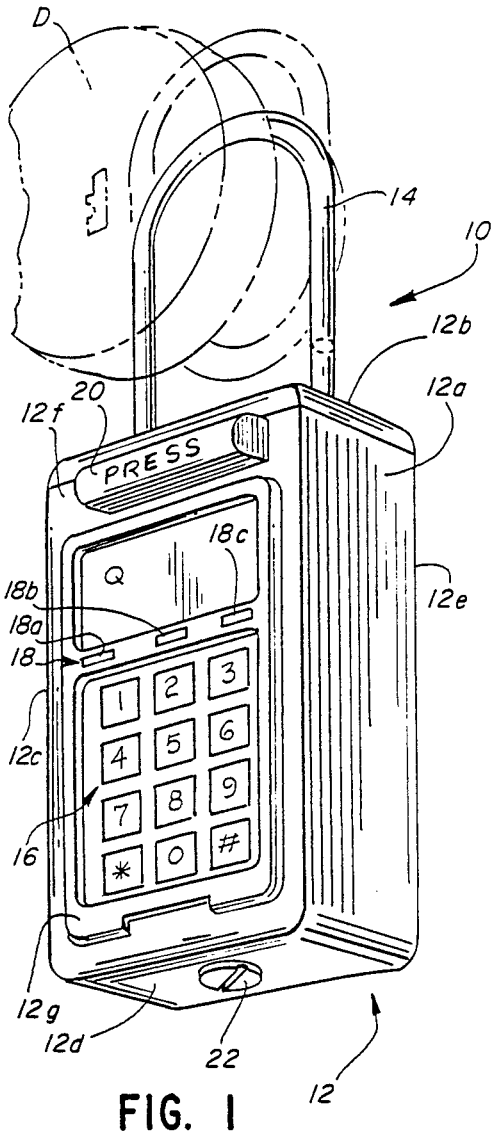
FIG. 1 is a perspective view of a lock system in accordance with the present invention supported on a doorknob.

While this invention is susceptible of embodiment in many different forms, there is shown in the drawing and will be described herein in detail specific embodiments thereof with the understanding that the present disclosure is to be considered as an exemplification of the principles of the invention and is not intended to limit the invention to the specific embodiments illustrated.

With respect to the figures, a lock system 10 is illustrated hanging from a doorknob D. The lock system 10 includes a housing 12 and a cylindrical U-shaped shackle 14. The shackle 14 can be used to removably affix the lock system 10 to the doorknob D The housing 12 is formed with four rigidly connected sides **12*a* through 12*d* and a fixedly attached back panel 12*e*. A front flange 12*f* is attached to front edges of each of the sides 12*a*–12*d***.

The housing 12 also includes a pivotably attached locking door 12g which also functions as a front panel member. The housing 12 defines an interior volume 15 bounded by the sides 12a through 12d, the rear panel 12e and the pivotably mounted door 12g.

Mounted on the door 12g is a 12-key keypad 16. Also mounted on the door 12g are a plurality of indicators 18. The indicators 18 can be implemented as low power light emitting diodes. The indicators 18 can be selected so as to emit light of different colors such as a yellow diode 18a, a green diode 18b and a red diode 18c.

Mounted on the front flange 12f is an elongated, manually operable, depressable, door opener 20. A battery recharging access port 22 is mounted on the bottom panel 12d.

Figure 2:
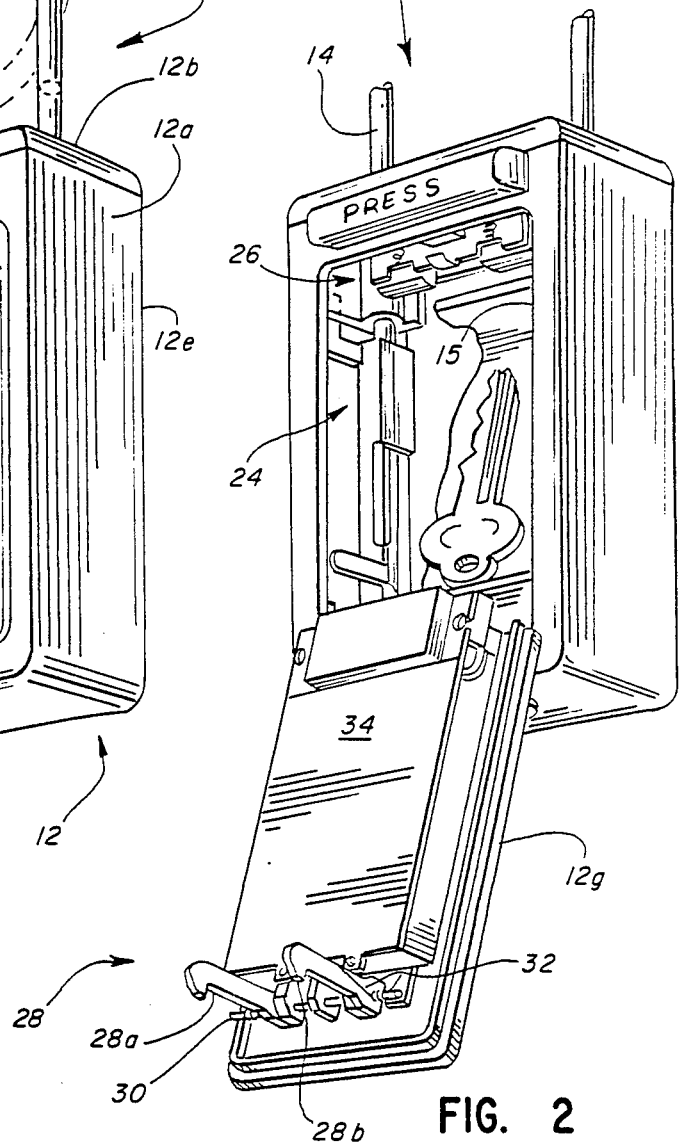
FIG. 2 is a perspective view of the lock system of FIG. 1 with a front panel pivoted to an open position and illustrating an interior region wherein a key can be stored.

In normal operation, the lock system 10 would be hung from a doorknob D as illustrated in FIG. 1. A key K for a lock associated with the doorknob D is stored in the interior region 15. When the door 12g is opened, as seen in FIG. 2, access is provided to the key K for purposes of opening the respective lock.

The shackle 14 has a first position where it is locked about the doorknob D, illustrated in FIG. 1. The shackle 14 is locked in position about the doorknob D, relative to the housing 12, by means of a retaining mechanism 24. The retaining mechanism 24 can be released when the door 12g is in the open position, as in FIG. 2.

Once released, the shackle 14 can be moved to a second position, illustrated in phantom in FIG. 1. The lock system 10 can be removed from the doorknob D for use elsewhere.

The lock system 10 includes a door latch or locking mechanism indicated generally at 26. The door latch mechanism 26 locks the door 12g closed until a valid combination has been entered, via the keypad 16, into the lock system 10. At that time the latch mechanism 26 is activated. The party entering the combination can then depress the elongated releasing bar 20. The door 12g is then pushed open slightly by an internal spring. The door 12g may then be manually opened the rest of the way to provide access to the key K.

The door 12g carries a set of locking pawls 28 which engage the latch mechanism 24 when the door is closed. Each pawl 28 includes a locking cam surface 28a and an unlocking cam surface 28b.

The locking pawls 28 are pivotably attached via a pivot shaft 30 to the door 12g. The locking pawls 28 are continuously forced to a first or locking position by springs 32.

The door 12g also carries electronic circuitry in a housing 34. The electronic circuitry is coupled to the keypad 16 and actuates the latch mechanism 26 in response to a valid combination having been entered via the keypad 16. The housing 34 could be plugable into the lock system 10 for easy replacement.

Figure 3:
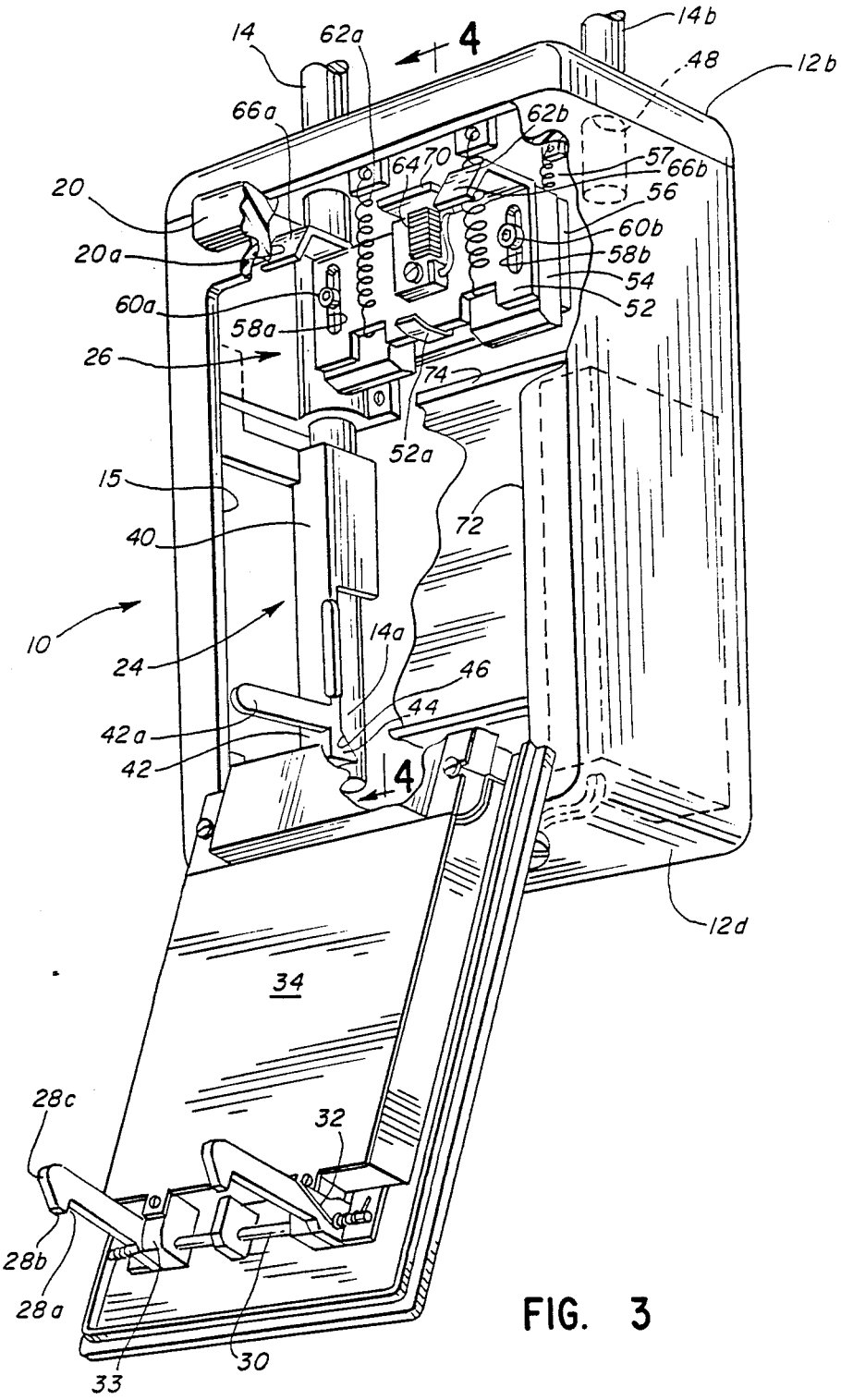
FIG. 3 is an enlarged view, in perspective, partly broken away, illustrating various components of the lock system of FIG. 1.

With respect to FIG. 3, the shackle 14 is slidably retained within the interior volume 15 by a flange 40 pivotably attached to the side walls 12c. An elongated end 42 of the flange 40 carries a locking wedge 44. The wedge 44 can engage a correspondingly shaped recess 46 at an end 14a of the shackle 14.

Cooperative interaction between the locking wedge 44 and the wedge-shaped recess 46 on the shackle 14 provides a strong yet simple mechanism for locking the shackle 14 about the doorknob D. The locking wedge 44 can be released by tripping a finger lug 42a and sliding the shackle 14 out of the top surface 12b of the housing 12.

When the locking wedge 44 is engaging the recess 46, a free end 14b of the shackle 14 extends through a boring 48 in the top surface 12b. The free end 14b is thus locked to the housing 12 when the locking wedge 44 engages the recess 46. In this condition, the shackle 14 does not rotate with respect to the housing 12.

When the finger lug 42a has been tripped permitting the locking wedge 44 to move away from the recess 46, the free end 14b can be withdrawn from the boring 48 to facilitate removal of the system 10 from the doorknob D.

The latch mechanism 26 includes a sliding cam plate 52, a rigidly mounted locking block 54 and a sliding locking plate 56. The rigidly mounted locking block 54 is fixedly attached to the interior of the housing 12. The sliding cam plate 52 an elongated, essentially rectangular member includes first and second slots 58a and b which permit linear movement thereof with respect to the locking block 54. Screws 60a and b which extend through the slots 58a and b slidably affix the cam plate 52 to the locking block 54. The locking plate 56 is slidably affixed to the locking block 54 in a similar fashion.

Biasing springs 62a and 62b bias the locking plate 56 upperwardly towards the top member 12D. A solenoid 64 is fixedly attached to and carried by the cam plate 52. The solenoid 64 could be covered by a protective housing if desired.

The cam plate 52 also carries a pair of spaced-apart cam surfaces 66a and 66b. The cam surfaces 66a and 66b slidably engage a corresponding elongated surface 20a on the depressable release member 20. As the release member 20 is depressed, the surface 20a slidably engages the cam surfaces 60a and b. This slidable engagement forces the slidable cam plate 52 downward toward the bottom member 12d of the housing 12.

The locking plate 56 is essentially rectangular in shape. A return or biasing spring 57 pulls the locking plate upwardly to the top panel 12b. A metal extension 70 is affixed to the plate 56 and is positioned over an end of the solenoid 64. As is discussed further subsequently, in response to energizing the solenoid 64, the upper portion 70 of the locking plate 56 is attracted toward the solenoid.

As a result of this attraction, the upper portion 70 moves toward the solenoid 64. The portion 70 can move into contact with an end of the solenoid 64. Movement of the upper portion 70 also causes the remainder of the sliding locking plate 56 to move downwardly toward the bottom surface 12D of the housing 12.

A battery 72 is mounted within the interior region 15 as a source of energy for the system 10. To frame the portion of the region 15 wherein the key K is stored, a premolded rectangular box 74 with an open front can be positioned within the interior region 15. The keybox 74 can be glued or affixed to the interior of the housing 12 in any convenient fashion.

FIGS. 4 through 8 illustrate a sequence of operations for opening the door 12g in response to a sequence or combination of characters having been entered through the keypad 16. In FIG. 4 the relative relationship of the various members of the system 10 prior to a valid combination having been entered is illustrated. In this state, sliding locking plate 56 is located at its uppermost position adjacent the top panel 12b in response to forces generated by the spring 57. Cam surface 56a carried by the sliding locking plate 56 is spaced-apart from unlocking cam surface 28b carried by the locking pawls 28. Further, locking cam surface 28a is lockingly engaged with a locking surface 54*b* of the block 54 for the purpose of keeping the door 12*g* closed.

Subsequent to a valid combination having been detected by the system 10, the solenoid 64 can be, as described below, energized. With respect to FIG. 6, in response to the solenoid 64 having been energized, the upper portion 70 of the slidable locking plate 56 moves downwardly in a direction 80 from the top panel 12B of the housing 12 until it contacts the solenoid 64. In this condition, the unlocking cam surface 56*a* comes into contact with the unlocking surface 28*b* on the locking pawls 28. Movement of the upper portion 70 and the locking plate 56 in the direction 80 stretches the biasing spring 57.

Figure 7:
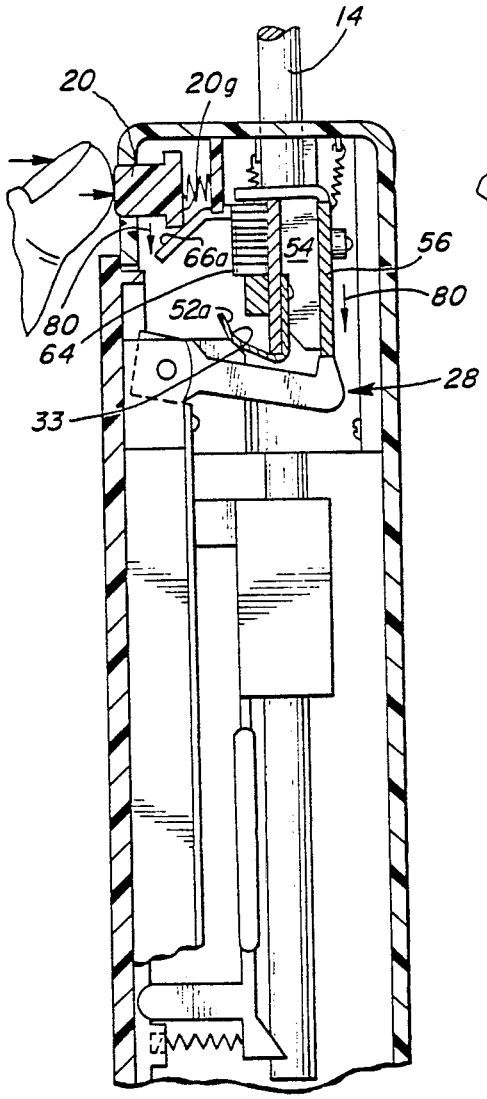
FIG. 7 is an enlarged fragmentary side sectional view of the lock system of FIG. 1 taken along plane 4—4 of FIG. 3 illustrating manually induced movement of members of the lock system causing the lock mechanism to unlock the front panel.

Once the valid, enabled combination has been detected by the system 10, in addition to energizing the solenoid 64 the green light emitting diode 18*b*, can be energized. Upon light from the green light emitting diode 18*b* being observed, the operator can then manually depress the release member 20 as illustrated in FIG. 7. In response to this depression, the surface 20*a* engages cam surfaces 66*a* and 66*b*. This slidable engagement forces the cam plate 52, and the sliding locking plate 56, both of which are temporarily coupled together by the solenoid 64, downwardly in the direction 80.

Movement in the direction 80 deflects the spring 52*a* causing it to bear against a cam surface 33 of the door 12*g*. In addition, the movement of the locking plate 56 in the direction 80 due to the interaction of the cam surfaces 56*a* and 28*b* deflects the locking pawls 28 downwardly also in the direction 80. This movement releases the locking pawls 28 from the fixed locking block 54.

Figure 8:
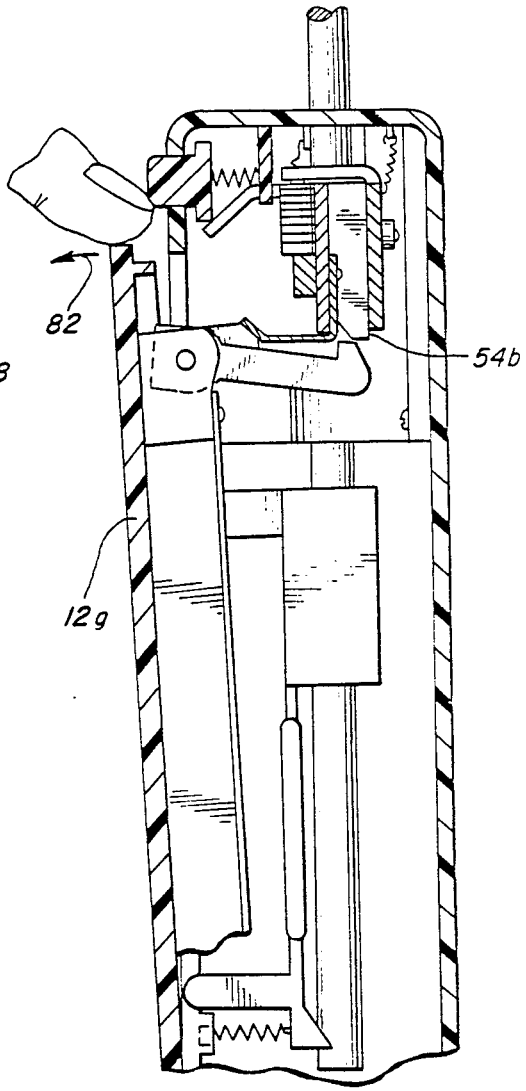
FIG. 8 is an enlarged fragmentary side sectional view of a portion of the lock system of FIG. 1 taken along plane 4—4 of FIG. 3 illustrating the front panel in an intermediate position between its locked position and its fully opened position.
Figure 9:
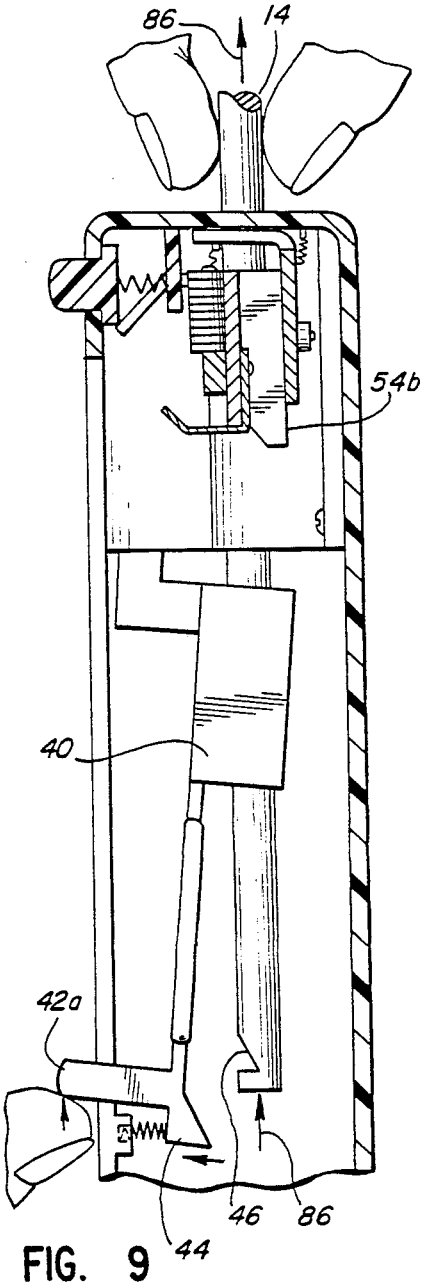
FIG. 9 is a fragmentary enlarged sectional view of the lock system of FIG. 1 taken along plane 4—4 of FIG. 3 illustrating relative movement of a doorknob clamping shackle with respect to the housing of the lock system.
Figure 10:
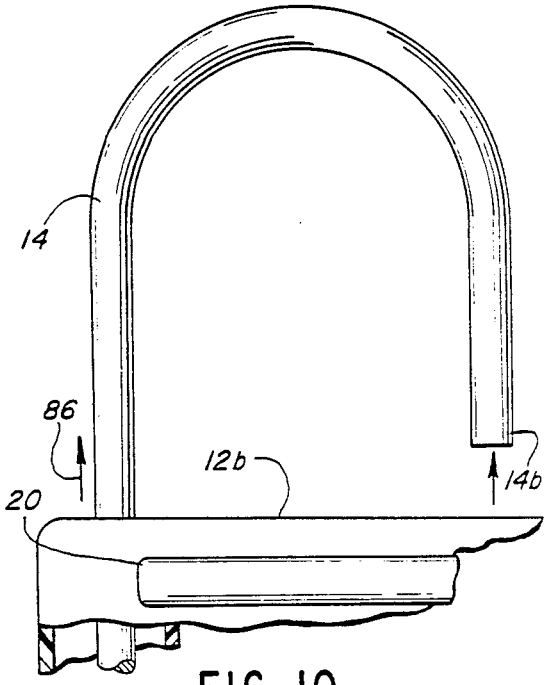
FIG. 10 is an enlarged fragmentary front plan view, partly in section, illustrating relative position of the shackle and the housing such that the lock system can be removed from the supporting doorknob.

As illustrated in FIG. 8, in response to the force from deflected release spring 52*a* the door 12*g*, which has now been released from the stationary locking block 54, rotates slightly in a direction 82 to a position intermediate its locked and its open positions. Movement in the direction 82 in response to the deflected spring 52*a* is great enough that the locking surfaces 28*a* of the locking pawls 28 no longer engage the locking surfaces 54*b* of the stationary locking block 54. The operator can then manually open the unlocked door 12*g* the remainder of the way.

With the door 12*g* opened, the operator can manually move the finger lug 42*a* thereby releasing the wedge 44 from the locking surface 46. The shackle 14 can then be moved in a direction 86 to release the system 10 from the doorknob D. Alternately, the key K can be removed from the keybox 74 and the respective lock unlocked.

Figure 11:
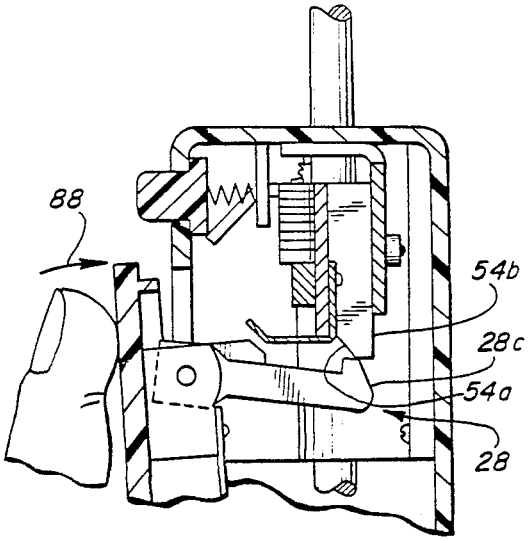
FIG. 11 is an enlarged, fragmentary, side sectional view of the lock system of FIG. 1 illustrating interaction of members of the lock mechanism as the front panel is being pivoted into its closed position.

To reclose the door 12*g* the operator merely rotates it, as illustrated in FIG. 11 in a direction 88 opposite the direction 82. The locking pawls 28 which carry the cam surfaces 28*c* will deflect and slide past the stationary locking block 54 due to interaction with the cam surfaces 54*a*. The system 10 will then return to its locked condition as illustrated in FIG. 4.

Figure 12:
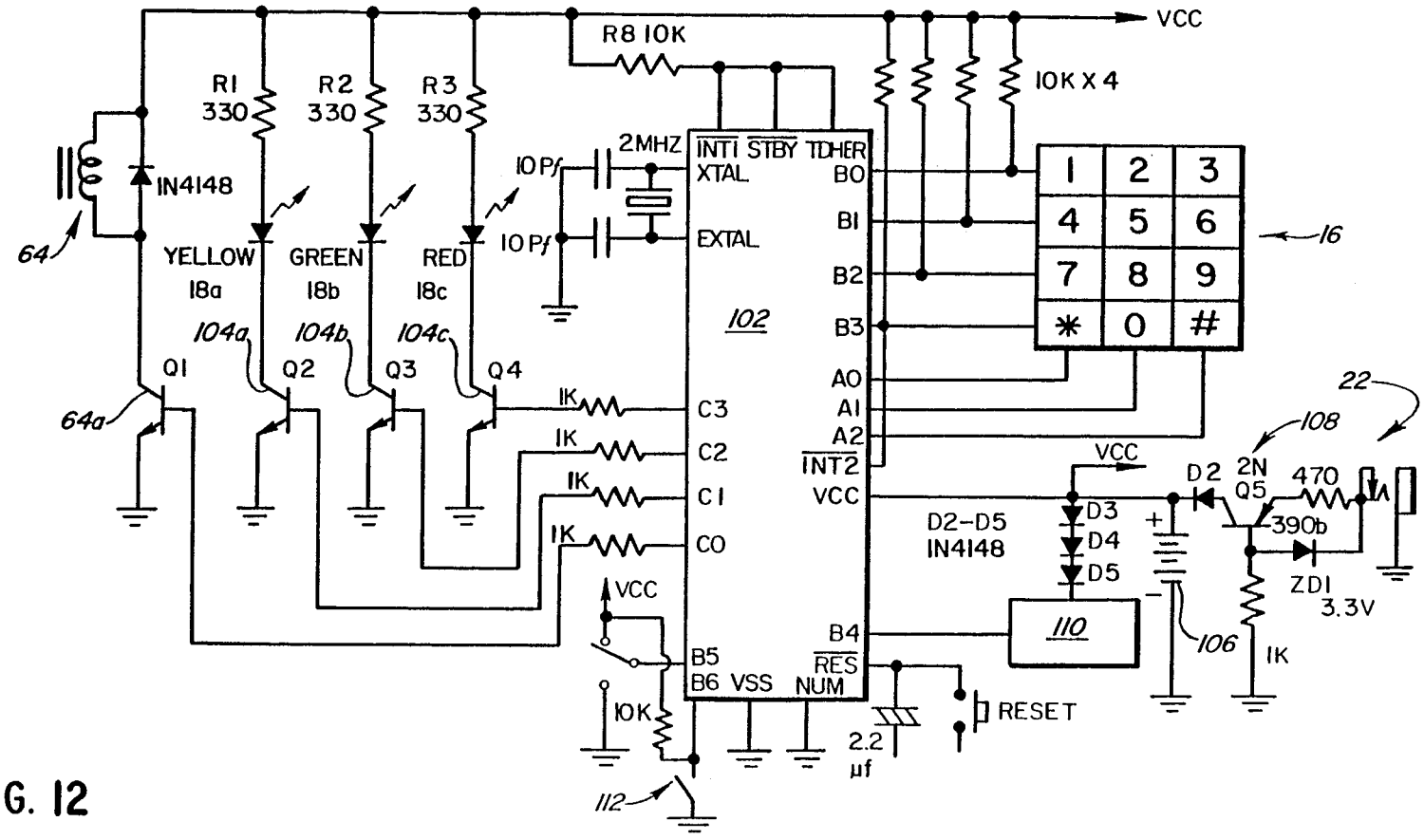
FIG. 12 is a schematic diagram of a control system for use with the lock system of FIG. 1.

Control circuitry 100 for the system 10 is illustrated in the schematic of FIG. 12. The control circuitry 100 is carried within the container 34. The control circuitry 100 includes a programmable processor 102, type HD63705. The processor 102 includes read-only memory for program storage as well as storage for a plurality of predetermined valid combinations. The processor 102 also includes random access storage.

The processor 102 is electrically coupled to the keypad 16. The processor is also coupled to the plurality 18 of light emiting diodes 18*a*, 18*b* and 18*c*.

Driver transistors 104*a*, 104*b* and 104*c* provide drive current to the light emiting diodes 18 in response to control signals from the processor 102. The processor 102 is also coupled, via a driver 64*a*, to the electrical coil of the solenoid 64.

The circuitry 100 is powered by a rechargeable battery 106. The battery 106 can be recharged through the access port 22. A recharging and current limiting circuit 108 is provided between the access port 22 and the battery 106. Integrated circuit 110 is a low voltage detector. When the voltage of the battery 106 drops below a predetermined value, the red light emitting diode 18*c* is energized. The circuit 110 is a type S8053.

A switch 112 provides a signal indicating that the door 12*q* is open. Switch 112 can be located adjacent the base member 12*d*.

The processor 102 includes both read only memory for program storage as well as read only memory for storage of a plurality of valid combinations. In a preferred embodiment, a plurality of valid combinations such as 300 can be provided. Valid combinations could be represented by a 5, 6 or 7 digit number. It will be understood that the number of digits selected to represent a valid combination is not a limitation of the present invention.

In one embodiment of the invention, each combination is useable at any time but is useable only once. Once that combination has been used to open the lock system 10 it is disabled until the lock system 10 is reset using a provided reset function.

It will be understood that a variety of implementations are possible. The exact number of times a given combination may be used is not a limitation of the present invention. For example, each combination could be used twice if desired rather than just once.

The locking system 10 thus provides a convenient and cost effective way to control access to the key K stored therein. Each time a combination is issued to a party desiring access to the key K, that combination can be used just to provide one access. Subsequent accesses will require another combination. It is of further significance with respect to the present invention that all valid combinations are equivalent and any valid combination can be used at any time.

Figure 13:
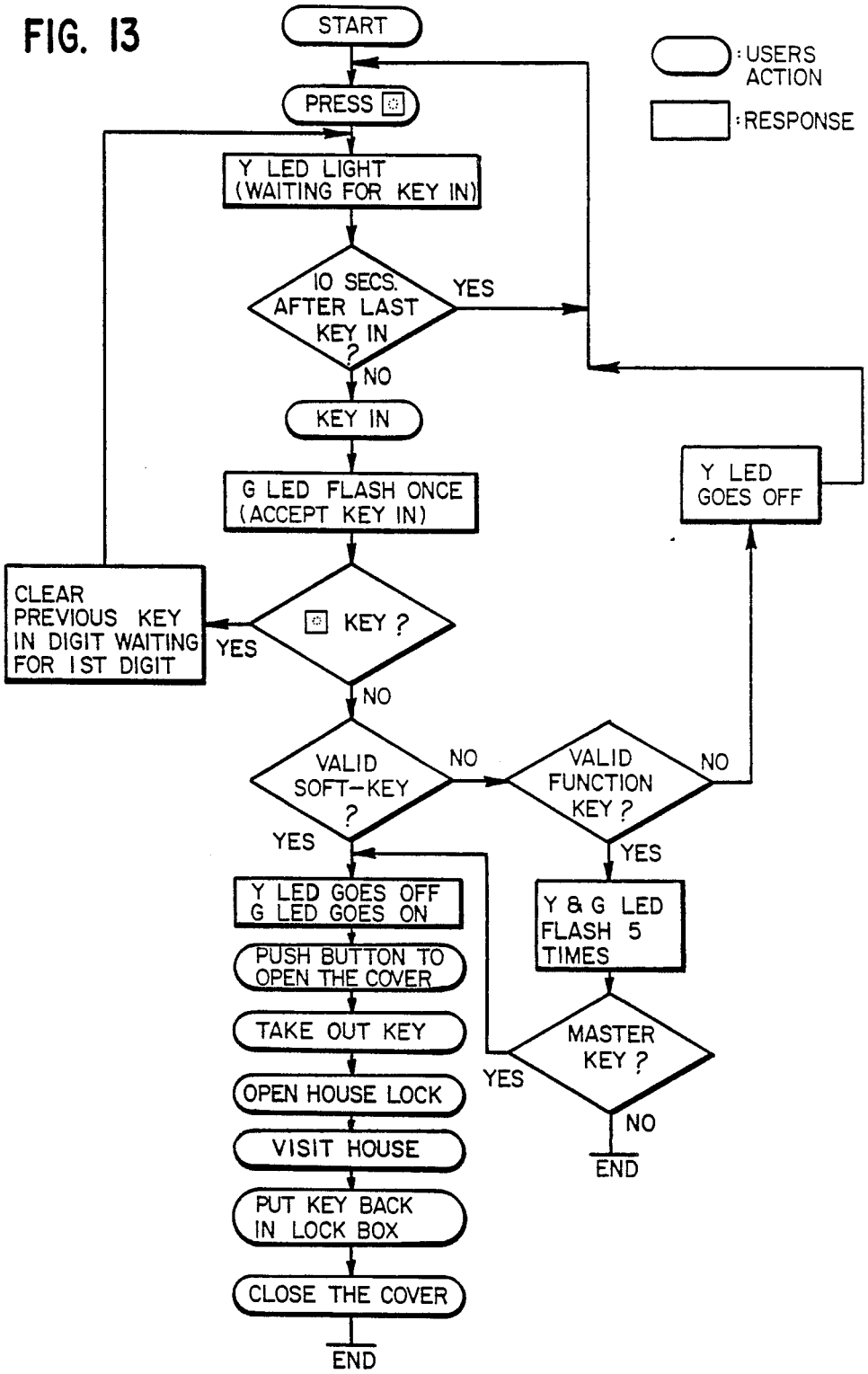
FIG. 13 is a block diagram of a sequence of steps involved in opening the lock system of FIG. 1.

FIG. 13 is a flow diagram illustrating operation of the lock system 10. In an initial step, an operator depresses the "*" key on the keypad 16. The system 10 then illuminates the yellow light emitting diode 18*a*. This indicates that the system 10 is awaiting operator entry of a sequence or combination. The system 10 keeps track of the amount of time between entered digits. If more than ten seconds elapses between digits, the system automatically resets to its initial condition. Each time a character or digit is entered by depressing a key on the keypad 16, the green light emitting diode 18*b* flashes.

Upon receipt of a 5, 6 or 7 character key combination, the system 10 checks to determine whether of not a valid sequence has been entered. If not the system then checks to determine whether or not one of four valid function codes has been entered.

A valid sequence or combination is one which matches a member of a predetermined set of valid combinations. The predetermined set of combinations can be stored in memory or generated for comparison to entered combinations.

If a valid function code has been detected, the system 10 then flashes both the yellow and green light emitting diodes. The four available functions are: (1) a deactivate function which disables the prestored sequences or soft keys until the system 10 has been reactivated; (2) a reactivate function which reactivates the disabled soft keys; (3) a restart function which enables all of the used and disabled soft keys; and (4) a master function which always opens the door 12g and cannot be disabled.

In the event that a valid, lock opening, sequence or soft key has been detected, the green light emitting diode is turned on indicating to the operator to depress the bar 20. The front panel 12g then is unlocked and moves outwardly in the direction 82. The operator can then remove the key K and open the lock associated with the doorknob D. Upon completion of the visit, the key K can be returned to the key box 74 in the system 10. The front panel 12g can then be reclosed which automatically relocks it.

The predetermined list of one-use soft keys could be created and stored in memory when the processor 102 is programmed. Preferably, to minimize storage, the list of soft keys can be determined each time that an operator enters a potential lock opening combination. Preferably, the next soft key $S_{n+1}$ can be determined as follows:

$$S_{n+1} = M \text{ of } (S_n * C) \quad (1)$$

Where $S_n$ is the previous valid soft key, a non-zero integer and C is an integer non-zero constant. The operation indicated by "M of" is a modulo $10^6$ operation which limits a valid soft key to 999,999 or less. In Table 1, $S_0$ equals 100 and C equals 5.

TABLE 1

| | $S_n$ | $S_{n+1}$ |
|---|---|---|
| $S_0$ | 100 | 500 |
| $S_1$ | 500 | 2500 |
| $S_2$ | 2500 | 12500 |
| $S_3$ | 12500 | 62500 |
| $S_4$ | 62500 | 312500 |

As each soft key is generated by equation (1), it can be compared to the entered combination. A match, provided that the key has not already been used, energizes the solenoid 64.

Once a soft key has been used, a record of that use is stored in non-volatile memory in the processor 102. That list of used combinations is checked after each match. If there is an entry in the non-volatile memory indicating prior use, the solenoid will not be engaged.

Use of the reactivate special function code will clear the list in volatile memory, thereby reactivating all of the valid combinations. The master function code can always be used to activate and unlock the system 10.

In the above described sequence, each soft key or predetermined combination is valid for use once. After a soft key has been detected, the system 10 generates an indicia which is stored in memory which indicates that that particular soft key has been used and is now deactivated. It will be understood that it would be within the spirit and scope of the present invention to permit a given soft key to open the lock system 10 more than one time before deactivating that soft key. In addition, it will be understood that the system 10 could be equipped with a two level soft key. A master level could enable one or more groups of prestored soft keys. Once enabled, a soft key from an enabled group could be used to open the lock system 10 one or more times.

FIG. 14 is an alternate embodiment of the present invention. In the embodiment of FIG. 14 an electronic lock system 120 in accordance with the present invention has been mounted in a door C. The system 120 includes a keypad 122 similar to the keypad 16. The lock system 120 also includes a manually depressable member 124. In contradistinction to the system 10, the system 120 does not include an openable front panel. As an alternate, the system 120 includes a dead bolt latch member 126. The dead bolt latch member 126 locks the door C closed against the supporting framework F.

As illustrated in FIGS. 15–17, when the system 120 detects a valid soft key that has been entered through the keypad 122 a light emitting diode corresponding to the light emitting diode 18b is turned on. Pressing the manually operable member 124 then moves the dead bolt latch from its locked to its unlocked position. The door C can then be opened providing access into the framework F.

When the door C is reclosed, the dead bolt latch 126 automatically relocks the door C closed. As in the case of the lock system 10, each time a valid soft key is used to open the lock system 120 the control circuitry checks to determine whether or not that soft key should be disabled. If so, that particular soft key will no longer function to open the lock system 120.

While the lock system 120 has been illustrated hanging by the shackle 14 from the doorknob D it will be understood that the exact mode of associating the lock system with a respective area is not a limitation of the invention. For example, the lock system 10 could be fixedly attached to the side of a building. Alternately it could be equipped with a hanger. The hanger can be positioned over the top of a door and the lock system 10 would then be removably affixed to the top section of a closed door.

As an alternate to the manually depressable member 20, a twistable knob could be used. Alternately, a slidable member rather than a depressable member could be used.

The lock system 10 or 120 can be used in any application wherein it is desirable to limit access to a region. If the lock system 120 is installed on a door C which is affixed to a parking lot money collection box daily access to the box can be provided to a collector. In this use of the lock system 120, the collector would receive a new combination each day and could only unlock the collection box once for that particular day.

Other uses of the present invention include access to a key for a rented vehicle. In general, the lock system 120 is usable wherever central control is required to provide access to a region.

In yet another installation, the lock system 120 could be utilized in hotels or motels. In this installation, the door C would correspond to a hotel or motel room door. An enabling sequence could be provided to a guest at check-in time. When the guest enters the enabling sequence through the keypad 122 the lock system is activated and can accept an arbitrary unlocking sequence to then be entered by the guest. In this mode of operation, the guest is free to specify an unlocking sequence to be used during this stay. This unlocking sequence can be used to operate the lock system 120 as many times as desired by the guest. At the end of the stay, the hotel or motel management can enter into the lock system 120 a disabling sequence. The lock will then stay disabled until a new enabling sequence is entered by the next guest.

Attached hereto as an Addendum is a listing of a computer program usable with the control system 100 to implement the flow diagram of FIG. 13.

From the foregoing, it will be observed that numerous variations and modifications may be effected without departing from the spirit and scope of the novel concept of the invention. It is to be understood that no limitation with respect to the specific apparatus illustrated herein is intended or should be inferred. It is, of course, intended to cover by the appended claims all such modifications as fall within the scope of the claims.

ADDENDUM 21-1

```
 1                                  ASCT    PAGEO
 2          0080                    ORG     $80
 3A 0080    0002          BACKUP    RMB     2          ;INITIAL CODE PATTEN
 4A 0082    0003          INITCD    RMB     3          ;RANDOM CODE'S INITIAL CODE
 5A 0085    0003          LASTCD    RMB     3          ;RANDOM CODE
 6A 0088    0001          INCOFG    RMB     1          ;INITIAL CODE FLAG
 7A 0089    0001          DISACT    RMB     1          ;DISABLE FLAG FFH=DISABLE
 8A 008A    0001          USER      RMB     1          ;END USE FLAG FFH=END
 9A 008B    0026          USEFLG    RMB     38         ;USED CODES FLAG 0=UNDER USE
10A 008I    0004          SPECD1    RMB     4          ;SPECIAL FUNACTION CODE BUFF
11A 008S    0004          SPECD2    RMB     4
12A 008Y    0004          SPECD3    RMB     4
13A 008D    0004          SPECD4    RMB     4
14A 00C1    0002          RADCNT    RMB     2          ;USED CODES COUNTER 0-300
15A 00C3    0002          TRDCNT    RMB     2          ;TEMP RANDOM CODES COUNTER
16A 00C5    0004          DEC       RMB     4          ;7-DIGIT BCD
17A 00C9    0003          HDATA     RMB     3          ;3-BYTE HEXADECIMALS
18A 00CC    0001          BCNTR     RMB     1          ;DIGIT COUNTER
19A 00CD    0003          BWORK     RMB     3          ;WORKAREA
20A 00D0    0003          MCAND     RMB     3          ;MULTIPLICAND
21A 00D3    0001          PRDCT     RMB     1          ;PRODUCT (UPPER BYTES)
22A 00D4    0002          DVD       RMB     2          ;DIVIDEND-->QUOTIENT
23A 00D6    0003          MER       RMB     3          ;MULTIPLIER-->PRODUCT
24A 00D9    0003          DVS       RMB     3          ;DIVISOR
25A 00DC    0003          RSD       RMB     3          ;RESIDUAL
26A 00DF    0001          RPORTC    RMB     1          ;PORTC STATUS REGISTER
27A 00E0    0001          LIGHT     RMB     1          ;GREEN LED TURN ON FLAG
28A 00E1    0004          DECD      RMB     4
29A 00E5    0001          CODEBF    RMB     1          ;KEYBOARD SCAN CODE BUFFER
30A 00E6    0001          CODCNT    RMB     1          ;KEYBOARD SCAN CODE COUNTER
31A 00E7    0001          KEYBUF    RMB     1          ;KEY BUFFER
32A 00E8    0001          DELBUF    RMB     1
33A 00E9    0001          TEMREG    RMB     1
34A 00EA    0001          TIMER1    RMB     1
35A 00EB    0001          TIMER2    RMB     1
36A 00EC    0001          TIMER3    RMB     1
37A 00ED    0001          TIMER4    RMB     1
38A 00EE    0001          ERRCNT    RMB     1
39A 00EF    0001          BESCNT    RMB     1
40A 00F0    0001          INDEX     RMB     1
41A 00F1    0001          INTFLG    RMB     1
42          1800                    ORG     $1800
43A 1800    9B            START     SEI                ;DISABLE INTERRUPT
44A 1801    9C                      RSP                ;RESET STACK POINT
45A 1802    A6 FF                   LDA     #0FFH
46A 1804    C7 0004                 STA     PADDR      ;SET PORTA TO OUTPUT
47A 1807    C7 0006                 STA     PCDDR      ;SET PORTC TO OUTPUT
48A 180A    A6 00                   LDA     #0
49A 180C    C7 0005                 STA     PBDDR      ;SET PORTB TO INPUT
50A 180F    A6 C7                   LDA     #11000111B
```

Copyright 1987
SEQWILL CORP.

```
51A 1811  C7 0000
52A 1814  A6 00
53A 1816  B7 DF
54A 1818  C7 0002
55A 1818  B7 E0
56A 181D  B7 F1
57A 181F  C6 004F
58A 1822  C7 0009
59A 1825  C6 1878
60A 1828  B7 D9
61A 182A  C6 1879
62A 182D  B7 DA
63A 182F  C6 187A
64A 1832  B7 D8
65A 1834  C6 1869
66A 1837  B7 D0
67A 1839  C6 186A
68A 183C  B7 D1
69A 183E  C6 186B
70A 1841  B7 D2
71A 1843  A6 05
72A 1845  B7 EE
73A 1847  B6 80
74A 1849  A1 55
75A 184B  26 06
76A 184D  36 81
77A 184F  A1 AA
78A 1851  27 07
79A 1853  A6 00
80A 1855  B7 88
81A 1857  CC 1861
82A 185A  A6 FF
83A 185C  B7 88
84A 185E  CC 1878
85
86A 1861  12 E0
87A 1863  CC 1878
88
89A 1866  91 67 14
90A 1869  01 00 03
91A 186C  01 04 07 0A 02 05
          08 00 03 06 09 0B

92A 1878  7F BD 91
93
94A 187B  3F C5
95A 187D  3F C6
96A 187F  3F C7
97A 1881  3F C8
98A 1883  3F E6
99A 1885  08 01 02
100A 1888  16 DF
101A 188A  12 DF
102A 188C  B6 DF
103A 188E  C7 0002
104A 1891  A6 0F
105A 1893  C7 0009
106A 1896  9A
107A 1897  CD 19DA
108
109A 189A  A6 FE
110A 189C  C7 0000
111A 189F  C6 0001
112A 18A2  AA F0
113A 18A4  43
114A 18A5  26 24
115A 18A7  A6 FD
116A 18A9  C7 0000
117A 18AC  C6 0001
118A 18AF  AA F0
119A 18B1  43
120A 18B2  26 3F
121A 18B4  A6 FB
122A 18B6  C7 0000
123A 18B9  C6 0001
124A 18BC  AA F0
125A 18BE  43
126A 18BF  26 4C
127A 18C1  CD 1A11
128A 18C4  B8 EB
```

```
        STA     PORTA
        LDA     #00000000B
        STA     RPORTC
        STA     PORTC
        STA     LIGHT           ;DISABLE LED FLAG
        STA     INTFLG
        LDA     TMINCD
        STA     TMCTRG          ;DISABLE TIMER INTERRUPT
        LDA     ROMDVS
        STA     DVS
        LDA     ROMDVS+1
        STA     DVS+1
        LDA     ROMDVS+2
        STA     DVS+2
        LDA     RMCAND
        STA     MCAND
        LDA     RMCAND+1
        STA     MCAND+1
        LDA     RMCAND+2
        STA     MCAND+2
        LDA     #5
        STA     ERRCNT
        LDA     BACKUP
        CMP     #$55            ;CHECK INITIAL CODE
        BNE     MEINIO          ;IF INITIAL CODE NOT SETU
        LDA     BACKUP+1
        CMP     #$AA
        BEQ     MEINI1
MEINIO  LDA     #0
        STA     INCOFG
        JMP     CODING
MEINI1  LDA     #$FF
        STA     INCOFG
        JMP     MAIN
;-----------------------------------------------------
CODING  BSET    1,LIGHT
        JMP     MAIN
;-----------------------------------------------------
SPECD5  FCB     $91,$67,$14
RMCAND  FCB     $01,$00,$03
CODEO   FCB     1,4,7,10,2,5,8,0,3,6,9,11

ROMDVS  FCB     $7F,$BD,$91
;-----------------------------------------------------
MAIN    CLR     DEC
        CLR     DEC+1
        CLR     DEC+2
        CLR     DEC+3
        CLR     CODCNT
        BRSET   4,PORTB,MAIN2
        BSET    3,RPORTC
MAIN2   BSET    1,RPORTC
        LDA     RPORTC
        STA     PORTC
        LDA     #TMSET
        STA     TMCTRG
        CLI
        JSR     RELEAS
;-----------------------------------
KEYSCA  LDA     #11111110B
        STA     PORTA
        LDA     PORTB
        ORA     #$F0
        COM     A
        BNE     COL00
KSCAN1  LDA     #11111101B
        STA     PORTA
        LDA     PORTB
        ORA     #$F0
        COM     A
        BNE     COL10
KSCAN2  LDA     #11111011B
        STA     PORTA
        LDA     PORTB
        ORA     #$F0
        COM     A
        BNE     COL20
KSCAN3  JSR     DEL10M
        LDA     TIMER2
```

```
129A 18C6  26 D2                 BNE     KEYSCA
130A 18C8  CC 1973               JMP     TIMOUT
131                        ;-----------------------------
132A 18C8  B7 E7           COL00 STA     KEYBUF
133A 18CD  CD 1A11               JSR     DEL10M
134A 18D0  A6 FE                 LDA     #11111110B
135A 18D2  C7 0000               STA     PORTA
136A 18D5  C6 0001               LDA     PORTB
137A 18D8  AA F0                 ORA     #$F0
138A 18DA  43                    COM     A
139A 18DB  27 8D                 BEQ     KEYSCA
140A 18DD  B1 E7                 CMP     KEYBUF
141A 18DF  26 B9                 BNE     KEYSCA
142A 18E1  AE 00                 LDX     #0
143A 18E3  B6 E7           COL01 LDA     KEYBUF
144A 18E5  44              COL02 LSR     A
145A 18E6  25 03                 BCS     COL03
146A 18E8  5C                    INC     X
147A 18E9  20 FA                 BRA     COL02
148A 18EB  D6 186C         COL03 LDA     CODE0,X
149A 18EE  B7 E5                 STA     CODEBF
150A 18F0  CC 192D               JMP     DIRECT
151                        ;-----------------------------
152A 18F3  B7 E7           COL10 STA     KEYBUF
153A 18F5  CD 1A11               JSR     DEL10M
154A 18F8  A6 FD                 LDA     #11111101B
155A 18FA  C7 0000               STA     PORTA
156A 18FD  C6 0001               LDA     PORTB
157A 1900  AA F0                 ORA     #$F0
158A 1902  43                    COM     A
159A 1903  27 95                 BEQ     KEYSCA
160A 1905  B1 E7                 CMP     KEYBUF
161A 1907  26 91                 BNE     KEYSCA
162A 1909  AE 04                 LDX     #4
163A 190B  20 D6                 BRA     COL01
164                        ;-----------------------------
165A 190D  B7 E7           COL20 STA     KEYBUF
166A 190F  CD 1A11               JSR     DEL10M
167A 1912  A6 FB                 LDA     #11111011B
168A 1914  C7 0000               STA     PORTA
169A 1917  C6 0001               LDA     PORTB
170A 191A  AA F0                 ORA     #$F0
171A 191C  43                    COM     A
172A 191D  26 03                 BNE     COL21
173A 191F  CC 189A               JMP     KEYSCA
174A 1922  B1 E7           COL21 CMP     KEYBUF
175A 1924  27 03                 BEQ     COL22
176A 1926  CC 189A               JMP     KEYSCA
177A 1929  AE 08           COL22 LDX     #8
178A 192B  20 B6                 BRA     COL01
179                        ;-----------------------------
180A 192D  A6 05           DIRECT LDA    #5
181A 192F  B7 EA                 STA     TIMER1
182A 1931  10 E0                 BSET    0,LIGHT
183A 1933  B6 E5                 LDA     CODEBF
184A 1935  A1 0A                 CMP     #10
185A 1937  26 0E                 BNE     DIR000
186A 1939  13 DF                 BCLR    1,RPORTC
187A 193B  13 02                 BCLR    1,PORTC
188A 193D  CD 19DA               JSR     RELEAS
189A 1940  12 DF                 BSET    1,RPORTC
190A 1942  12 02                 BSET    1,PORTC
191A 1944  CC 187B               JMP     MAIN
192A 1947  A1 08           DIR000 CMP    #11
193A 1949  26 03                 BNE     DIR002
194A 194B  CC 1A22               JMP     KEYEND
195A 194E  B6 E6           DIR002 LDA    CODCNT
196A 1950  A1 08                 CMP     #8
197A 1952  26 03                 BNE     DIR001
198A 1954  CC 1973               JMP     TIMOUT
199A 1957  3C E6           DIR001 INC    CODCNT
200A 1959  44                    LSR     A
201A 195A  97                    TAX
202A 195B  25 10                 BCS     ODD
203A 195D  B6 E5                 LDA     CODEBF
204A 195F  48                    ASL     A
205A 1960  48                    ASL     A
206A 1961  48                    ASL     A
207A 1962  48                    ASL     A
208A 1963  EA C5           DIR1  ORA     DEC,X
209A 1965  E7 C5                 STA     DEC,X
```

```
210A 1967  CD 19DA                JSR     RELEAS
211A 196A  CC 189A                JMP     KEYSCA
212A 196D  B6 E5          ODD     LDA     CODEBF
213A 196F  A4 OF                  AND     #$F
214A 1971  20 FO                  BRA     DIR1
215                       ;-----------------------------
216A 1973  A6 00          TIMOUT  LDA     #0
217A 1975  B7 EO                  STA     LIGHT
218A 1977  B7 DF                  STA     RPORTC
219A 1979  C7 0002                STA     PORTC
220A 197C  CD 19DA                JSR     RELEAS
221A 197F  3A EE                  DEC     ERRCNT
222A 1981  26 03                  BNE     STOP2
223A 1983  CD 19CO                JSR     DFIVE
224A 1986  A6 FE          STOP2   LDA     #11111110B
225A 1988  C7 0000                STA     PORTA
226A 1988  A6 12                  LDA     #18
227A 198D  B7 EC                  STA     TIMER3
228A 198F  A6 FF          LOOP51  LDA     #$FF
229A 1991  B7 EB                  STA     TIMER2
230A 1993  07 01 20       LOOP55  BRCLR   3,PORTB,RSTART
231A 1996  86 EB                  LDA     TIMER2
232A 1998  26 F9                  BNE     LOOP55
233A 199A  3A EC                  DEC     TIMER3
234A 199C  26 F1                  BNE     LOOP51
235A 199E  A6 05          ONSTOP  LDA     #5
236A 19A0  B7 EE                  STA     ERRCNT
237A 19A2  A6 FE                  LDA     #11111110B
238A 19A4  C7 0000                STA     PORTA
239A 19A7  A6 00                  LDA     #0
240A 19A9  C7 000A                STA     MISREG
241A 19AC  10 F1                  BSET    0,INTFLG
242A 19AE  9D                     NOP
243A 19AF  9D                     NOP
244A 19B0  8E                     STOP
245A 19B1  9D                     NOP
246A 19B2  11 F1                  BCLR    0,INTFLG
247A 19B4  9D                     NOP
248A 19B5  9D                     NOP
249A 1986  B6 88          RSTART  LDA     INCOFG
250A 1988  26 03                  BNE     STOP1
251A 198A  CC 1861                JMP     CODING
252A 198D  CC 187B        STOP1   JMP     MAIN
253                       ;-----------------------------
254A 19C0  A6 12          DFIVE   LDA     #18
255A 19C2  B7 EC                  STA     TIMER3
256A 19C4  A6 FF          LOOPO1  LDA     #$FF
257A 19C6  B7 EB                  STA     TIMER2
258A 19C8  B6 EB          LOOP    LDA     TIMER2
259A 19CA  26 FC                  BNE     LOOP
260A 19CC  3A EC                  DEC     TIMER3
261A 19CE  26 F4                  BNE     LOOPO1
262A 19D0  81                     RTS
263                       ;-----------------------------
264A 19D1  A6 E6          FIFT    LDA     #230
265A 19D3  B7 EB                  STA     TIMER2
266A 19D5  B6 EB          LOOPO2  LDA     TIMER2
267A 19D7  26 FC                  BNE     LOOPO2
268A 19D9  81                     RTS
269                       ;-----------------------------
270A 19DA  A6 03          RELEAS  LDA     #3
271A 19DC  B7 EF                  STA     SESCNT
272A 19DE  A6 FE          REL1    LDA     #11111110B
273A 19EO  C7 0000                STA     PORTA
274A 19E3  C6 0001                LDA     PORTB
275A 19E6  AA FO                  ORA     #$FO
276A 19E8  43                     COM     A
277A 19E9  26 EF                  BNE     RELEAS
278A 19EB  A6 FD                  LDA     #11111101B
279A 19ED  C7 0000                STA     PORTA
280A 19FO  C6 0001                LDA     PORTB
281A 19F3  AA FO                  ORA     #$FO
282A 19F5  43                     COM     A
283A 19F6  26 E2                  BNE     RELEAS
284A 19F8  A6 FB                  LDA     #11111011B
285A 19FA  C7 0000                STA     PORTA
286A 19FD  C6 0001                LDA     PORTB
287A 1A00  AA FO                  ORA     #$FO
288A 1A02  43                     COM     A
289A 1A03  26 D5                  BNE     RELEAS
```

```
290A 1A05  CD 1A11                JSR     DEL10M
291A 1A08  3A EF                  DEC     BESCNT
292A 1A0A  26 D2                  BNE     REL1
293A 1A0C  A6 99                  LDA     #153
294A 1A0E  B7 E8                  STA     TIMER2
295A 1A10  81                     RTS
296                         ;-------------------------
297A 1A11  A6 82            DEL10M LDA    #178
298A 1A13  B7 E8                  STA     DELBUF
299A 1A15  3C E9            DEL100 INC    TEMREG
300A 1A17  3A E9                  DEC     TEMREG
301A 1A19  3C E9                  INC     TEMREG
302A 1A1B  3A E9                  DEC     TEMREG
303A 1A1D  3A E8                  DEC     DELBUF
304A 1A1F  26 F4                  BNE     DEL100
305A 1A21  81                     RTS
306                         ;-------------------------
307A 1A22  B6 88            KEYEND LDA    INCOFG
308A 1A24  26 03                  BNE     KENDO
309A 1A26  CC 1AE7                JMP     KEND1
310A 1A29  B6 E6            KENDO  LDA    CODCNT
311A 1A2B  A1 06                  CMP     #6
312A 1A2D  24 03                  BCC     KENDO3
313A 1A2F  CC 1973                JMP     TIMOUT
314A 1A32  26 03            KENDO3 BNE    KENDO4
315A 1A34  CC 1B5F                JMP     INITCD
316A 1A37  A1 08            KENDO4 CMP    #8
317A 1A39  26 03                  BNE     KENDO5
318A 1A3B  CC 1B88                JMP     SPCFUN
319A 1A3E  B6 89            KENDO5 LDA    DISACT
320A 1A40  27 03                  BEQ     KENDO1
321A 1A42  CC 1B77                JMP     DISABL
322A 1A45  B6 8A            KENDO1 LDA    USER
323A 1A47  27 03                  BEQ     KENDO2
324A 1A49  CC 1B8C                JMP     ENDUSE
325A 1A4C  CD 1BFE          KENDO2 JSR    BCD
326A 1A4F  B6 C9                  LDA     HDATA
327A 1A51  B7 85                  STA     LASTCD
328A 1A53  B6 CA                  LDA     HDATA+1
329A 1A55  B7 86                  STA     LASTCD+1
330A 1A57  B6 CB                  LDA     HDATA+2
331A 1A59  B7 87                  STA     LASTCD+2
332A 1A5B  3F C3                  CLR     TRDCNT
333A 1A5D  3F C4                  CLR     TRDCNT+1
334A 1A5F  B6 82                  LDA     INITCD
335A 1A61  B7 D6                  STA     MER
336A 1A63  B6 83                  LDA     INITCD+1
337A 1A65  B7 D7                  STA     MER+1
338A 1A67  B6 84                  LDA     INITCD+2
339A 1A69  B7 D8                  STA     MER+2
340A 1A6B  CD 1C5C          GRAD1  JSR    MUL
341A 1A6E  CD 1C89                JSR     DIV
342A 1A71  B6 85                  LDA     LASTCD
343A 1A73  B1 DC                  CMP     RSD
344A 1A75  26 0F                  BNE     GRAD2
345A 1A77  B6 86                  LDA     LASTCD+1
346A 1A79  B1 DD                  CMP     RSD+1
347A 1A7B  26 09                  BNE     GRAD2
348A 1A7D  B6 87                  LDA     LASTCD+2
349A 1A7F  B1 DE                  CMP     RSD+2
350A 1A81  26 03                  BNE     GRAD2
351A 1A83  CC 1AA6                JMP     CHKFLG
352A 1A86  3C C3            GRAD2  INC    TRDCNT
353A 1A88  26 02                  BNE     GRAD3
354A 1A8A  3C C4                  INC     TRDCNT+1
355A 1A8C  01 C4 09         GRAD3  BRCLR  0,TRDCNT+1,GRAD4
356A 1A8F  A6 2C                  LDA     #$2C
357A 1A91  B1 C3                  CMP     TRDCNT
358A 1A93  26 03                  BNE     GRAD4
359A 1A95  CC 1973                JMP     TIMOUT
360A 1A98  B6 DC            GRAD4  LDA    RSD
361A 1A9A  B7 D6                  STA     MER
362A 1A9C  B6 DD                  LDA     RSD+1
363A 1A9E  B7 D7                  STA     MER+1
364A 1AA0  B6 DE                  LDA     RSD+2
365A 1AA2  B7 D8                  STA     MER+2
366A 1AA4  20 C5                  BRA     GRAD1
367                         ;-------------------------
368A 1AA6  B6 C3            CHKFLG LDA    TRDCNT
369A 1AA8  A4 07                  AND     #00001111B
```

```
370A 1AAA  34 C4                 LSR    TRDCNT+1
371A 1AAC  36 C3                 ROR    TRDCNT
372A 1AAE  34 C3                 LSR    TRDCNT
373A 1AB0  34 C3                 LSR    TRDCNT
374A 1AB2  BE C3                 LDX    TRDCNT
375A 1AB4  4C                    INC    A
376A 1AB5  B7 C3                 STA    TRDCNT
377A 1AB7  A6 01                 LDA    #00000001B
378A 1AB9  B7 C4                 STA    TRDCNT+1
379A 1AB8  E6 8B                 LDA    USEFLG,X
380A 1ABD  46              CHFLG1 ROR    A
381A 1ABE  3A C3                 DEC    TRDCNT
382A 1AC0  27 04                 BEQ    CHFLG2
383A 1AC2  38 C4                 LSL    TRDCNT+1
384A 1AC4  20 F7                 BRA    CHFLG1
385A 1AC6  25 1C           CHFLG2 BCS    CHFLG5
386A 1AC8  B6 C4                 LDA    TRDCNT+1
387A 1ACA  EA 8B                 ORA    USEFLG,X
388A 1ACC  E7 8B                 STA    USEFLG,X
389A 1ACE  3C C1                 INC    RADCNT
390A 1AD0  26 02                 BNE    CHFLG3
391A 1AD2  3C C2                 INC    RADCNT+1
392A 1AD4  01 C2 0A        CHFLG3 BRCLR  0,RADCNT+1,CHFLG4
393A 1AD7  B6 C1                 LDA    RADCNT
394A 1AD9  A1 2C                 CMP    #$2C
395A 1ADB  26 04                 BNE    CHFLG4
396A 1ADD  A6 FF                 LDA    #$FF
397A 1ADF  B7 8A                 STA    USER
398A 1AE1  CC 1D04         CHFLG4 JMP    OPEN
399A 1AE4  CC 1973         CHFLG5 JMP    TIMOUT
400                        ;-----------------------------
401A 1AE7  B6 E6           KEND1  LDA    CODCNT
402A 1AE9  A1 07                  CMP    #7
403A 1AEB  27 03                  BEQ    KEND10
404A 1AED  CC 1973                JMP    TIMOUT
405A 1AF0  CD 18FE         KEND10 JSR    BCD
406A 1AF3  AE 00                  LDX    #0
407A 1AF5  BF F0           KEND11 STX    INDEX
408A 1AF7  B6 C9                  LDA    HDATA
409A 1AF9  B7 D6                  STA    MER
410A 1AFB  B6 CA                  LDA    HDATA+1
411A 1AFD  B7 D7                  STA    MER+1
412A 1AFF  B6 CB                  LDA    HDATA+2
413A 1B01  B7 D8                  STA    MER+2
414A 1B03  CD 1C5C                JSR    MUL
415A 1B06  CD 1C89                JSR    DIV
416A 1B09  C6 00DC                LDA    HEXD
417A 1B0C  B7 C9                  STA    HDATA
418A 1B0E  C6 00DD                LDA    HEXD+1
419A 1B11  B7 CA                  STA    HDATA+1
420A 1B13  C6 00DE                LDA    HEXD+2
421A 1B16  B7 CB                  STA    HDATA+2
422A 1B18  CD 1CCE                JSR    HEX
423A 1B1B  BE F0                  LDX    INDEX
424A 1B1D  B6 E1                  LDA    DECD
425A 1B1F  E7 B1                  STA    SPECD1,X
426A 1B21  5C                     INC    X
427A 1B22  B6 E2                  LDA    DECD+1
428A 1B24  E7 B1                  STA    SPECD1,X
429A 1B26  5C                     INC    X
430A 1B27  B6 E3                  LDA    DECD+2
431A 1B29  E7 B1                  STA    SPECD1,X
432A 1B2B  5C                     INC    X
433A 1B2C  B6 E4                  LDA    DECD+3
434A 1B2E  E7 B1                  STA    SPECD1,X
435A 1B30  5C                     INC    X
436A 1B31  A3 10                  CPX    #16
437A 1B33  26 C0                  BNE    KEND11
438A 1B35  A6 55                  LDA    #$55
439A 1B37  B7 80                  STA    BACKUP
440A 1B39  43                     COM    A
441A 1B3A  B7 81                  STA    BACKUP+1
442A 1B3C  A6 FF                  LDA    #$FF
443A 1B3E  B7 88                  STA    INCOFG
444A 1B40  13 E0                  BCLR   1,LIGHT
445A 1B42  A6 00                  LDA    #0
446A 1B44  B7 DF                  STA    RPORTC
447A 1B46  C7 0002                STA    PORTC
448A 1B49  B7 8A                  STA    USER
```

```
449A 1B4B  B7 89                STA     DISACT
450A 1B4D  B6 C9                LDA     HDATA
451A 1B4F  B7 82                STA     INITCD
452A 1B51  B6 CA                LDA     HDATA+1
453A 1B53  B7 83                STA     INITCD+1
454A 1B55  B6 CB                LDA     HDATA+2
455A 1B57  B7 84                STA     INITCD+2
456A 1B59  CD 18A8              JSR     ENBFLG
457A 1B5C  CC 199E              JMP     ONSTOP
458                     ;-------------------------
459A 1B5F  AE 03        INITCO  LDX     #3
460A 1B61  E6 C4        INITOO  LDA     DEC-1,X
461A 1B63  D1 1B65              CMP     SPECD5-1,X
462A 1B66  26 0C                BNE     INITO1
463A 1B68  5A                   DEC     X
464A 1B69  26 F6                BNE     INITOO
465A 1B6B  A6 00                LDA     #0
466A 1B6D  B7 80                STA     BACKUP
467A 1B6F  B7 88                STA     INCOFG
468A 1B71  CC 1986              JMP     RSTART
469A 1B74  CC 1973      INITO1  JMP     TIMOUT
470                     ;-------------------------
471A 1B77  12 E0        DISABL  BSET    1,LIGHT
472A 1B79  A6 23        DISAB1  LDA     #35
473A 1B7B  B7 EB                STA     TIMER2
474A 1B7D  B6 EB        DISABO  LDA     TIMER2
475A 1B7F  26 FC                BNE     DISABO
476A 1B81  3F E0                CLR     LIGHT
477A 1B83  CC 1D17              JMP     OPEN2
478A 1B86  11 E0        ENDUSE  BCLR    0,LIGHT
479A 1B88  13 E0                BCLR    1,LIGHT
480A 1B8A  14 E0                BSET    2,LIGHT
481A 1B8C  B6 DF                LDA     RPORTC
482A 1B8E  A4 F9                AND     #11111001B
483A 1B90  B7 DF                STA     RPORTC
484A 1B92  C7 0002              STA     PORTC
485A 1B95  20 E2                BRA     DISAB1
486A 1B97  11 E0        COPSPC  BCLR    0,LIGHT
487A 1B99  13 E0                BCLR    1,LIGHT
488A 1B9B  14 E0                BSET    2,LIGHT
489A 1B9D  13 DF                BCLR    1,RPORTC
490A 1B9F  14 DF                BSET    2,RPORTC
491A 1BA1  B6 DF                LDA     RPORTC
492A 1BA3  C7 0002              STA     PORTC
493A 1BA6  20 D1                BRA     DISAB1
494                     ;-------------------------
495A 1BA8  A6 00        ENBFLG  LDA     #0
496A 1BAA  AE 26                LDX     #38
497A 1BAC  E7 8A        ENFLGO  STA     USEFLG-1,X
498A 1BAE  5A                   DEC     X
499A 1BAF  26 FB                BNE     ENFLGO
500A 1BB1  B7 C1                STA     RADCNT
501A 1BB3  B7 C2                STA     RADCNT+1
502A 1BB5  B7 8A                STA     USER
503A 1BB7  81                   RTS
504                     ;-----------------------------------------------
505A 1BB8  AE 04        SPCFUN  LDX     #4
506A 1BBA  E6 C4        SPFUN1  LDA     DEC-1,X
507A 1BBC  E1 B0                CMP     SPECD1-1,X
508A 1BBE  26 0A                BNE     SPFUN2
509A 1BC0  5A                   DEC     X
510A 1BC1  26 F7                BNE     SPFUN1
511A 1BC3  A6 FF                LDA     #$FF
512A 1BC5  B7 89                STA     DISACT
513A 1BC7  CC 1B97              JMP     COPSPC
514A 1BCA  AE 04        SPFUN2  LDX     #4
515A 1BCC  E6 C4        FUN2    LDA     DEC-1,X
516A 1BCE  E1 B4                CMP     SPECD2-1,X
517A 1BD0  26 0A                BNE     SPFUN3
518A 1BD2  5A                   DEC     X
519A 1BD3  26 F7                BNE     FUN2
520A 1BD5  A6 00                LDA     #0
521A 1BD7  B7 89                STA     DISACT
522A 1BD9  CC 1B97              JMP     COPSPC
523A 1BDC  AE 04        SPFUN3  LDX     #4
524A 1BDE  E6 C4        FUN3    LDA     DEC-1,X
525A 1BE0  E1 B8                CMP     SPECD3-1,X
526A 1BE2  26 09                BNE     SPFUN4
527A 1BE4  5A                   DEC     X
528A 1BE5  26 F7                BNE     FUN3
```

```
529A 1BE7  CD 18A8                 JSR     ENEFLG
530A 1BEA  CC 1B97                 JMP     COPSPC
531A 1BED  AE 04          SPFUN4   LDX     #4
532A 1BEF  E6 C4          FUN4     LDA     DEC-1,X
533A 1BF1  E1 BC                   CMP     SPECD4-1,X
534A 1BF3  26 06                   BNE     ENDSPE
535A 1BF5  5A                      DEC     X
536A 1BF6  26 F7                   BNE     FUN4
537A 1BF8  CC 1D04                 JMP     OPEN
538A 1BFB  CC 1973        ENDSPE   JMP     TIMOUT
539                       ;-----------------------------------------------
540                       ;CONVERTING 7-DIGIT BCD INTO 3-BYTE HEXADECIMALS
541                       ;         DEC:    7-DIGIT BCD
542                       ;         HDATA:  3-BYTE HEXADECIMALS
543                       ;         BWORK:  WORK AREA
544                       ;         BCNTR:  DIGIT COUNTER
545                       ;-----------------------------------------------
546A 1BFE  AE C5          BCD      LDX     #DEC
547A 1C00  A6 07                   LDA     #7
548A 1C02  B7 CC                   STA     BCNTR
549A 1C04  3F C9                   CLR     HDATA
550A 1C06  3F CA                   CLR     HDATA+1
551A 1C08  3F CB                   CLR     HDATA+2
552A 1C0A  00 CC 16       BCD1     BRSET   0,BCNTR,BCD4
553A 1C0D  F6                      LDA     0,X
554A 1C0E  A4 0F                   AND     #$F
555A 1C10  BB CB          BCD2     ADD     HDATA+2
556A 1C12  B7 CB                   STA     HDATA+2
557A 1C14  4F                      CLR     A
558A 1C15  B9 CA                   ADC     HDATA+1
559A 1C17  B7 CA                   STA     HDATA+1
560A 1C19  4F                      CLR     A
561A 1C1A  B9 C9                   ADC     HDATA
562A 1C1C  B7 C9                   STA     HDATA
563A 1C1E  3A CC                   DEC     BCNTR
564A 1C20  26 08                   BNE     BCD5
565A 1C22  81                      RTS
566                       ;-----------------------------
567A 1C23  F6             BCD4     LDA     0,X
568A 1C24  44                      LSR     A
569A 1C25  44                      LSR     A
570A 1C26  44                      LSR     A
571A 1C27  44                      LSR     A
572A 1C28  20 E6                   BRA     BCD2
573A 1C2A  01 CC 01       BCD5     BRCLR   0,BCNTR,BCD3
574A 1C2D  5C                      INC     X
575A 1C2E  38 CB          BCD3     ASL     HDATA+2
576A 1C30  39 CA                   ROL     HDATA+1
577A 1C32  39 C9                   ROL     HDATA
578A 1C34  B6 C9                   LDA     HDATA
579A 1C36  B7 CD                   STA     BWORK
580A 1C38  B6 CA                   LDA     HDATA+1
581A 1C3A  B7 CE                   STA     BWORK+1
582A 1C3C  B6 CB                   LDA     HDATA+2
583A 1C3E  B7 CF                   STA     BWORK+2
584A 1C40  48                      ASL     A
585A 1C41  39 CA                   ROL     HDATA+1
586A 1C43  39 C9                   ROL     HDATA
587A 1C45  48                      ASL     A
588A 1C46  39 CA                   ROL     HDATA+1
589A 1C48  39 C9                   ROL     HDATA
590A 1C4A  BB CF                   ADD     BWORK+2
591A 1C4C  B7 CB                   STA     HDATA+2
592A 1C4E  B6 CE                   LDA     BWORK+1
593A 1C50  B9 CA                   ADC     HDATA+1
594A 1C52  B7 CA                   STA     HDATA+1
595A 1C54  B6 CD                   LDA     BWORK
596A 1C56  B9 C9                   ADC     HDATA
597A 1C58  B7 C9                   STA     HDATA
598A 1C5A  20 AE                   BRA     BCD1
599                       ;-----------------------------------------------
600                       ;         MULTIPLYING 24-BIT BINARY DATA
601                       ;MCAND:   MULTIPLICAND
602                       ;PRDCT:   PRODUCT (UPPER BYTES)
603                       ;MER:     MULTIPLIER -->PRODUCT (LOWER BYTES)
604                       ;-----------------------------------------------
605A 1C5C  3F D3          MUL      CLR     PRDCT
606A 1C5E  3F D4                   CLR     PRDCT+1
607A 1C60  3F D5                   CLR     PRDCT+2
608A 1C62  AE 18                   LDX     #24
```

```
609A 1C64  01 D8 12        MUL1    BRCLR   0,MER+2,MUL2
610A 1C67  B6 D2                   LDA     MCAND+2
611A 1C69  BB D5                   ADD     PRDCT+2
612A 1C6B  B7 D5                   STA     PRDCT+2
613A 1C6D  B6 D1                   LDA     MCAND+1
614A 1C6F  B9 D4                   ADC     PRDCT+1
615A 1C71  B7 D4                   STA     PRDCT+1
616A 1C73  B6 D0                   LDA     MCAND
617A 1C75  B9 D3                   ADC     PRDCT
618A 1C77  B7 D3                   STA     PRDCT
619A 1C79  36 D3           MUL2    ROR     PRDCT
620A 1C7B  36 D4                   ROR     PRDCT+1
621A 1C7D  36 D5                   ROR     PRDCT+2
622A 1C7F  36 D6                   ROR     MER
623A 1C81  36 D7                   ROR     MER+1
624A 1C83  36 D8                   ROR     MER+2
625A 1C85  5A                      DEC     X
626A 1C86  26 DC                   BNE     MUL1
627A 1C88  81                      RTS
628                        ;-----------------------------------------------
629                        ;       DIVIDING 40-24 BIT BINARY DATA
630                        ;       DVD:   DIVIDEND -->QUOTIENT
631                        ;       DVS:   DIVISOR
632                        ;       RSD:   RESIDUAL
633                        ;-----------------------------------------------
634A 1C89  AE 28           DIV     LDX     #40
635A 1C8B  3F DC                   CLR     RSD
636A 1C8D  3F DD                   CLR     RSD+1
637A 1C8F  3F DE                   CLR     RSD+2
638A 1C91  99              DIV1    SEC
639A 1C92  39 D8                   ROL     DVD+4
640A 1C94  39 D7                   ROL     DVD+3
641A 1C96  39 D6                   ROL     DVD+2
642A 1C98  39 D5                   ROL     DVD+1
643A 1C9A  39 D4                   ROL     DVD
644A 1C9C  39 DE                   ROL     RSD+2
645A 1C9E  39 DD                   ROL     RSD+1
646A 1CA0  39 DC                   ROL     RSD
647A 1CA2  B6 DE                   LDA     RSD+2
648A 1CA4  B0 D8                   SUB     DVS+2
649A 1CA6  B7 DE                   STA     RSD+2
650A 1CA8  B6 DD                   LDA     RSD+1
651A 1CAA  B2 DA                   SBC     DVS+1
652A 1CAC  B7 DD                   STA     RSD+1
653A 1CAE  B6 DC                   LDA     RSD
654A 1CB0  B2 D9                   SBC     DVS
655A 1CB2  B7 DC                   STA     RSD
656A 1CB4  24 14                   BCC     DIV2
657A 1CB6  B6 D8                   LDA     DVS+2
658A 1CB8  BB DE                   ADD     RSD+2
659A 1CBA  B7 DE                   STA     RSD+2
660A 1CBC  B6 DA                   LDA     DVS+1
661A 1CBE  B9 DD                   ADC     RSD+1
662A 1CC0  B7 DD                   STA     RSD+1
663A 1CC2  B6 D9                   LDA     DVS
664A 1CC4  B9 DC                   ADC     RSD
665A 1CC6  B7 DC                   STA     RSD
666A 1CC8  3A D8                   DEC     DVD+4
667A 1CCA  5A              DIV2    DEC     X
668A 1CCB  26 C4                   BNE     DIV1
669A 1CCD  81                      RTS
670                        ;-----------------------------------------------
671                        ;CONVERTING 3-BYTE HEXADECIMALS INTO 8-DIGIT BCD
672                        ;    HEXD:  3-BYTE HEXADECIMALS
673                        ;    DECD:  8-DIGIT BCD
674                        ;    HCNTR: SUBTRACTION COUNTER
675                        ;-----------------------------------------------
676A 1CCE  3F E1           HEX     CLR     DECD
677A 1CD0  3F E2                   CLR     DECD+1
678A 1CD2  3F E3                   CLR     DECD+2
679A 1CD4  3F E4                   CLR     DECD+3
680A 1CD6  A6 18                   LDA     #24
681A 1CD8  C7 00CC                 STA     HCNTR
682A 1CDB  38 DE           HEX1    ASL     HEXD+2
683A 1CDD  39 DD                   ROL     HEXD+1
684A 1CDF  39 DC                   ROL     HEXD
685A 1CE1  AE 04                   LDX     #4
686A 1CE3  E6 E0           HEX2    LDA     DECD-1,X
687A 1CE5  E9 E0                   ADC     DECD-1,X
688A 1CE7  8D                      DAA
```

```
689A 1CE8  E7 E0
690A 1CEA  5A
691A 1CEB  26 F6
692A 1CED  3A CC
693A 1CEF  26 EA
694
695A 1CF1  AE 03
696A 1CF3  B6 E1
697A 1CF5  EB E1
698A 1CF7  8D
699A 1CF8  5A
700A 1CF9  26 FA
701A 1CFB  48
702A 1CFC  48
703A 1CFD  48
704A 1CFE  48
705A 1CFF  BA E1
706A 1D01  B7 E1
707A 1D03  81
708
709A 1D04  A6 00
710A 1D06  B7 E0
711A 1D08  A6 05
712A 1D0A  B7 DF
713A 1D0C  C7 0002
714A 1D0F  A6 E5
715A 1D11  B7 EB
716A 1D13  B6 EB
717A 1D15  26 FC
718A 1D17  A6 00
719A 1D19  B7 DF
720A 1D1B  C7 0002
721A 1D1E  CC 199E
722
723A 1D21  A6 0F
724A 1D23  C7 0009
725A 1D26  A6 40
726A 1D28  C7 000A
727A 1D2B  00 F1 42
728A 1D2E  3A EA
729A 1D30  3A EB
730A 1D32  3A ED
731A 1D34  04 E0 2A
732A 1D37  01 E0 13
733A 1D3A  14 DF
734A 1D3C  B6 EA
735A 1D3E  26 08
736A 1D40  11 E0
737A 1D42  B6 DF
738A 1D44  A8 04
739A 1D46  B7 DF
740A 1D48  B6 DF
741A 1D4A  C7 0002
742A 1D4D  03 E0 20
743A 1D50  B6 ED
744A 1D52  A4 03
745A 1D54  26 1A
746A 1D56  B6 DF
747A 1D58  A8 02
748A 1D5A  B7 DF
749A 1D5C  C7 0002
750A 1D5F  20 0F
751A 1D61  B6 ED
752A 1D63  A4 03
753A 1D65  26 09
754A 1D67  B6 DF
755A 1D69  A8 06
756A 1D6B  B7 DF
757A 1D6D  C7 0002
758A 1D70  80
759
760A 1D71  80
761
762        1FF4
763A 1FF4  1800
764A 1FF6  1800
765A 1FF8  1D21
766A 1FFA  1D71
767A 1FFC  1800
768A 1FFE  1800
```

```
        STA     DECD-1,X
        DEC     X
        BNE     HEX2
        DEC     HCNTR
        BNE     HEX1
;-----------------------------------------------
        LDX     #3
        LDA     DECD
HEX3    ADD     DECD,X
        DAA
        DEC     X
        BNE     HEX3
        LSL     A
        LSL     A
        LSL     A
        LSL     A
        ORA     DECD
        STA     DECD
        RTS
;-----------------------------------------------
OPEN    LDA     #0
        STA     LIGHT
        LDA     #00000101B
        STA     RPORTC
        STA     PORTC
        LDA     #229
        STA     TIMER2
OPEN1   LDA     TIMER2
        BNE     OPEN1
OPEN2   LDA     #0
        STA     RPORTC
        STA     PORTC
        JMP     ONSTOP
;-----------------------------------------------
INTSUB  LDA     #TMSET
        STA     TMCTRG
        LDA     #01000000B
        STA     MISREG
        BRSET   0,INTFLG,INTEND
        DEC     TIMER1
        DEC     TIMER2
        DEC     TIMER4
        BRSET   2,LIGHT,INT003
        BRCLR   0,LIGHT,INT002
        BSET    2,RPORTC
        LDA     TIMER1
        BNE     INT001
        BCLR    0,LIGHT
        LDA     RPORTC
        EOR     #00000100B
        STA     RPORTC
INT001  LDA     RPORTC
        STA     PORTC
INT002  BRCLR   1,LIGHT,INTEND
        LDA     TIMER4
        AND     #00000011B
        BNE     INTEND
        LDA     RPORTC
        EOR     #00000010B
        STA     RPORTC
        STA     PORTC
        BRA     INTEND
INT003  LDA     TIMER4
        AND     #00000011B
        BNE     INTEND
        LDA     RPORTC
        EOR     #00000110B
        STA     RPORTC
        STA     PORTC
INTEND  RTI
;-----------------------------------------------
INTSER  RTI
;-----------------------------------------------
        ORG     $1FF4
        FDB     START
        FDB     START
        FDB     INTSUB
        FDB     INTSER
        FDB     START
RESET   FDB     START
```

```
769                                  ;-----------------------------------------------
770          0000                    PORTA   EQU     0
771          0001                    PORTB   EQU     1
772          0002                    PORTC   EQU     2
773          0003                    PORTD   EQU     3
774          0004                    PADDR   EQU     4
775          0005                    PBDDR   EQU     5
776          0006                    PCDDR   EQU     6
777          0007                    PDDDR   EQU     7
778          0008                    TMDARG  EQU     8
779          0009                    TMCTRG  EQU     9
780          000A                    MISREG  EQU     10
781          004F                    TMINCD  EQU     01001111B
782          000F                    TMSET   EQU     00001111B
783          0099                    TMCONT  EQU     153
784          00CC                    HCNTR   EQU     BCNTR
785          00DC                    HEXD    EQU     RSD
786                                  ;-----------------------------------------------
787                                          END
Symbol Table:
BACKUP  0080  BCD     18FE  BCD1    1C0A  BCD2    1C10  BCD3    1C2E  BCD4    1C23
BCD5    1C2A  BCNTR   00CC  BESCNT  00EF  BWORK   00CD  CHFLG1  1A8D  CHFLG2  1AC6
CHFLG3  1AD4  CHFLG4  1AE1  CHFLG5  1AE4  CHKFLG  1AA6  CODCNT  00E6  CODEO   186C
CODEBF  00E5  CODING  1861  COL00   18CB  COL01   18E3  COL02   18E5  COL03   18EB
COL10   18F3  COL20   190D  COL21   1922  COL22   1929  COPSPC  1897  DEC     00C5
DECD    00E1  DEL100  1A15  DEL10M  1A11  DELBUF  00E8  DFIVE   19C0  DIR000  1947
DIR001  1957  DIR002  194E  DIR1    1963  DIRECT  192D  DISAB0  1B7D  DISAB1  1B79
DISABL  1B77  DISACT  0089  DIV     1C89  DIV1    1C91  DIV2    1CCA  DVD     00D4
DVS     00D9  ENBFLG  1BA8  ENDSPE  1BFB  ENDUSE  1B86  ENFLGO  18AC  ERRCNT  00EE
FIFT    19D1  FUN2    18CC  FUN3    18DE  FUN4    18EF  GRAD1   1A6B  GRAD2   1A86
GRAD3   1A8C  GRAD4   1A98  HCNTR   00CC  HDATA   00C9  HEX     1CCE  HEX1    1CD8
HEX2    1CE3  HEX3    1CF5  HEXD    00DC  INCOFG  0088  INDEX   00F0  INITOO  1B61
INIT01  1B74  INITCD  0082  INITCO  1B5F  INT001  1D48  INT002  1D4D  INT003  1D61
INTEND  1D70  INTFLG  00F1  INTSER  1D71  INTSUB  1D21  KENDO   1A29  KEND01  1A45
KEND02  1A4C  KEND03  1A32  KEND04  1A37  KEND05  1A3E  KEND1   1AE7  KEND10  1AF0
KEND11  1AF5  KEYBUF  00E7  KEYEND  1A22  KEYSCA  189A  KSCAN1  18A7  KSCAN2  1B64
KSCAN3  18C1  LASTCD  0085  LIGHT   00E0  LOOP    19C8  LOOP01  19C4  LOOP02  19D5
LOOP51  198F  LOOP55  1993  MAIN    1878  MAIN2   188A  MCAND   00D0  MEINIO  1853
MEINI1  185A  MER     00D6  MISREG  000A  MUL     1C5C  MUL1    1C64  MUL2    1C79
ODD     196D  ONSTOP  199E  OPEN    1D04  OPEN1   1D13  OPEN2   1D17  PADDR   0004
PBDDR   0005  PCDDR   0006  PDDDR   0007  PORTA   0000  PORTB   0001  PORTC   0002
PORTD   0003  PRDCT   00D3  RADCNT  00C1  REL1    19DE  RELEAS  19D4  RESET   1FFE
RMCAND  1869  ROMDVS  1878  RPORTC  00DF  RSD     00DC  RSTART  19B6  SPCFUN  1BB8
SPECD1  00B1  SPECD2  00B5  SPECD3  00B9  SPECD4  00BD  SPECD5  1866  SPFUN1  18BA
SPFUN2  18CA  SPFUN3  18DC  SPFUN4  18ED  START   1800  STOP1   198D  STOP2   19B6
TEMREG  00E9  TIMER1  0CEA  TIMER2  00EB  TIMER3  00EC  TIMER4  00ED  TIMOUT  1973
TMCONT  0099  TMCTRG  0009  TMDARG  0008  TMINCD  004F  TMSET   000F  TRDCNT  00C3
USEFLG  0088  USER    008A
RUN COMPLETE    -          0 ERRORS DETECTED
```

What is claimed is:

1. A lock system with a predetermined plurality of valid lock opening sequences with each member of the plurality usable for unlocking only a predetermined number of times, the lock system comprising:

a housing;

electrically, activated means, carried by said housing, for moving an unlocking member from a first position toward a second position in response to applied electrical energy;

means fixedly attached to said housing for entering an operator selectable sequence and for generating a plurality of electrical signals responsive thereto;

means for comparing said generated plurality of electrical signals to a predetermined plurality of lock opening sequences of electrical signals;

means for detecting a match between said generated plurality of electrical signals and one of said lock opening sequences and for generating an indicium thereof;

means for testing whether or not said matched sequence has been previously used the predetermined number of times and for electrically activating said moving means in response to said matched sequence not having been previously used the predetermined period of times thereby causing said unlocking member to move; and means for automatically setting an indicium indicating that said matched sequence has been used the predetermined number of times.

2. A lock system as in claim 1 with said moving means including a solenoid with said unlocking member movable, at least in part, from said first position toward said second position in response to electrical energy applied to said solenoid.

3. A lock system as in claim 2 wherein said housing carries manually operable means cooperative with said moving means for moving said unlocking member to said second position, in response to said solenoid having been energized.

4. A lock system as in claim 1 wherein said comparing means includes means for providing a predetermined plurality of lock opening sequences of electrical signals.

5. A lock system as in claim 1 with said moving means including:

mounting means affixed to a surface of said housing;

said unlocking member being slidably supported by said mounting means; and camming plate means slidably supported by said mounting means, for coupling to and for slidably moving said unlocking member in response to applied electrical energy toward said second position.

6. A lock system as in claim 5 including manually operable means, cooperable with said camming plate means, for moving said coupled unlocking member and said camming plate means in a direction so as to move said unlocking member to said second position.

7. A lock system as in claim 6 with said housing defining an interior region therein and pivotable means for lockably closing said region, said closing means unlocked and operable in response to said unlocking member having moved to said second position.

8. A lock system as in claim 1 with said comparing means including:

means for storing each member of said plurality of valid, lock opening sequences.

9. A lock system as in claim 1 with said comparing means including:

means for generating each member of said plurality of valid, lock opening sequences.

10. A lock system for permitting controlled access by an operator with a valid, single use, unlocking sequence to a selected region, the lock system comprising:

a housing;

latch means, supported by said housing for extending a locking member to a first, locking, position and retracting said member to a second, unlocking position;

keyboard means attached to said housing for entering an operator selected sequence and for generating a plurality of electrical signals in response thereto;

means for comparing said generated plurality of electrical signals to a predetermined plurality of single use lock opening sequences of electrical signals;

means for detecting a match between said generated plurality of electrical signals and one of said predetermined, single use lock opening sequences and for generating an indicium thereof;

means, responsive to said detected match, for testing whether or not said matched predetermined sequence has been used and for generating a non-use indicium in response to said sequence not having been used; and manually operable means cooperable with said latch means for assisting in moving said locking member to said second, unlocking, position only in response to said testing means having generated said non-use indicium.

11. A lock system as in claim 10 with said housing defining a cavity therein.

12. A lock system as in claim 11 with said latch means affixed to said housing, at least in part within said cavity.

13. A lock system as in claim 12 with said housing carrying a pivotably mounted closing panel, movable from a first position closing said cavity to a second position opening said cavity.

14. A lock system as in claim 13 with said closing panel lockable to said housing, in said first position, by said latch means.

15. A lock system as in claim 14 including biasing means carried within said cavity, at least when said closing panel is in said first position, for forcing said closing panel to a position intermediate between said first and said second positions in response to said locking member moving to said second, unlocking, position.

16. A lock system as in claim 14 with said latch means including an independently movable biased, cam plate means for intermittently coupling to a portion of said locking member; and manually operable means, carried by said housing for moving said cam plate means in a first direction with biasing means for moving said cam plate means opposite said first direction.

17. A lock system as in claim 16 with said cam plate means intermittently coupled to said locking means in response to applied electrical energy.

18. A lock system as in claim 17 with said cam plate means including an electrically actuated solenoid.

19. A lock system as in claim 17 wherein said determining means disables each said matched sequence in response to detecting a respective said indicia.

20. A lock system as in claim 17 wherein said determining means disables each said matched sequence in response to detecting that said respective indicia has been generated a predetermined number of times.

21. A lock system as in claim 10 with said locking member being a dead bolt.

22. A lock system as in claim 10 with said comparing means including means for sequentially generating each member of said plurality of predetermined lock opening sequences.

23. A lock system as in claim 10 with said comparing means including:

means for storing each member of said plurality of single use lock opening sequences.

24. A lock system as in claim 10 with said comparing means including:

means for generating each member of said plurality of valid, lock opening sequences.

25. An electromechanical safe comprising:

a housing having a plurality of wall members defining a region therein with a pivotably mounted front panel usable to close said region;

means for locking said front panel to said housing thereby closing said region;

manually operable means carried by said front panel for entering an unlocking sequence;

means for comparing an entered sequence to each member of a plurality of predetermined valid, unlocking sequences and for generating an indicium in response to a detected match;

electrical means, responsive to said indicium for determining if said entered matched sequence has been previously used; and means for unlocking said front panel in response to said matched sequence not having been previously used.

26. A safe as in claim 25 including means for affixing said housing to a predetermined member.

27. A safe as in claim 26 with said affixing means including a generally U-shaped shackle.

28. An electronic lock box unlockable with a combination from a plurality of one-use combinations, the lock box comprising:

a housing defining an interior region and carrying a movable locking member;

manually operable means fixedly carried by said housing for entering a predetermined one-use combination;

electronic means for sensing electrically an entered, valid, but unused combination from the plurality of one-use combinations and for releasing said locking member in response thereto; and means for marking said combination as valid but used to inhibit subsequent use thereof to release said locking member.

29. A portable key safe removably attachable to a selected member comprising:

a housing defining an interior storage region therein;

a movable door fixedly attached to said housing and manually movable from a first position to a second position;

manually operable switch means, permanently carried by said housing, for entering unlocking sequences;

electrically activated means for locking said door, when in said first position, to said housing, thereby closing said storage region;

control means, coupled to said switch means and said locking means, for detecting an entered unlocking sequence including means for storing a predetermined list of one-time unlocking combinations, and use indicating indicium associated with each said unlocking combination and means for comparing said entered unlocking sequence to at least some of the members of said stored list, including further means for generating a selected electrical signal in response to a match therebetween;

means for sensing said respective use indicating indicium in response to said selected electrical signal and for generating an unlocking electrical signal in response to non-use of said matched sequence;

means for activating said locking means in response to said unlocking electrical signal thereby permitting manual movement of said door to said second position and for changing said respective use indicating indicium to a used state; and means for attaching said housing to the selected member.

30. A portable key safe removably attachable to a selected member comprising:

a housing defining an interior storage region therein;

a movable door fixedly attached to said housing and manually movable from a first position to a second position;

manually operable switch means, permanently carried by said housing, for entering unlocking sequences;

electrically activated means for locking said door, when in said first position, to said housing, thereby closing said storage region;

control means, coupled to said switch means and said locking means, for detecting an entered unlocking sequence including means for generating, one at a time, a predetermined sequence of one-time unlocking combinations, including means for storing a list of each, previously used said unlocking combination, means for comparing said entered unlocking sequence to at least some members of said predetermined sequence and for indicating a match therebetween, means for comparing a said matching unlocking sequence to the members of said used list, including further means for generating a selected electrical signal in response to a non-match therebetween;

means for sensing the presence or absence of said selected electrical signal and for generating an unlocking electrical signal in response to the presence thereof;

means for activating said locking means in response to the presence of said unlocking electrical signal thereby permitting manual movement of said door to said second position including means for entering said matched unlocking sequence into said used list; and means for attaching said housing to the selected member.

* * * * *

UNITED STATES PATENT AND TRADEMARK OFFICE

CERTIFICATE OF CORRECTION

PATENT NO. : 4,838,052 
DATED : June 13, 1989
INVENTOR(S) : John P. Williams, Chin-Jung Huang and Wen-Chyl Shyu It is certified that error appears in the above-identified patent and that said Letters Patent is hereby corrected as shown below:

Title page,
Item [73], Assignee is identified, "Segwill Corp." should read -- Seqwill Corp. --.

Signed and Sealed this

Twenty-third Day of July, 2002

*Attest:*

*Attesting Officer*

JAMES E. ROGAN
*Director of the United States Patent and Trademark Office*